US009330832B2

(12) United States Patent
Swirhun et al.

(10) Patent No.: US 9,330,832 B2
(45) Date of Patent: May 3, 2016

(54) INTEGRATED TRANSFORMER BALUN WITH ENHANCED COMMON-MODE REJECTION FOR RADIO FREQUENCY, MICROWAVE, AND MILLIMETER-WAVE INTEGRATED CIRCUITS

(71) Applicant: Nokia Corporation, Espoo (FI)

(72) Inventors: Paul Stanley Swirhun, El Cerrito, CA (US); Andrew Patrick Townley, Berkeley, CA (US)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 13/766,158

(22) Filed: Feb. 13, 2013

(65) Prior Publication Data

US 2014/0225698 A1 Aug. 14, 2014

(51) Int. Cl.

| | |
|---|---|
| ***H01F 27/29*** | (2006.01) |
| ***H01F 21/02*** | (2006.01) |
| ***H01F 21/12*** | (2006.01) |
| ***H01F 5/00*** | (2006.01) |
| ***H01F 7/06*** | (2006.01) |
| *H01F 41/04* | (2006.01) |
| *H01F 27/28* | (2006.01) |

(52) U.S. Cl.

CPC ..... *H01F 27/292* (2013.01); *H01F 21/12* (2013.01); *H01F 27/29* (2013.01); *H01F 41/041* (2013.01); *H01F 41/04* (2013.01); *H01F 2021/125* (2013.01); *H01F 2027/2809* (2013.01); *Y10T 29/4902* (2015.01)

(58) Field of Classification Search

CPC ... H01F 27/292; H01F 27/2804; H01F 21/12; H01F 41/041; H01F 29/02; H01F 29/025; H01F 29/04; H01F 2021/125; H01F 2027/2809; H01F 17/0006; H01F 17/0013; Y10T 29/4902

USPC ..... 336/200, 232, 150, 182, 192, 145; 29/602.1

See application file for complete search history.

(56) References Cited

U.S. PATENT DOCUMENTS

| | | | |
|---|---|---|---|
| 6,838,970 B2 | 1/2005 | Basteres et al. | |
| 6,882,263 B2 | 4/2005 | Yang et al. | |
| 7,164,339 B2 * | 1/2007 | Huang | 336/200 |

(Continued)

FOREIGN PATENT DOCUMENTS

| | | |
|---|---|---|
| CN | 101414508 A | 4/2009 |

OTHER PUBLICATIONS

Translation of first Office Action for CN Patent Application No. 201410048966.2 dated Nov. 17, 2015.

*Primary Examiner* — Mangtin Lian
(74) *Attorney, Agent, or Firm* — Locke Lord LLP

(57) ABSTRACT

Apparatus and method example embodiments provide an improved common mode rejection ratio in high frequency transformer baluns. According to an example embodiment of the invention, an apparatus comprises a first winding of at least one turn forming a primary coil, having first and second differential leads oriented in a first direction, the primary coil formed in a first conductive layer over a substrate and the first differential lead of the primary coil being grounded; and a second winding of at least one turn forming a secondary coil, having a third and fourth differential leads oriented in a second direction offset by an angle of greater than zero degrees and less than 180 degrees from the first direction, the secondary coil formed in a second conductive layer separated by an insulating layer from the first conductive layer.

13 Claims, 15 Drawing Sheets

(56) References Cited

U.S. PATENT DOCUMENTS

| | | | | |
|---|---|---|---|---|
| 7,456,721 | B2 | 11/2008 | Chiu | |
| 7,482,904 | B2 | 1/2009 | Lee et al. | |
| 7,808,356 | B2 | 10/2010 | Papananos | |
| 7,821,372 | B2 | 10/2010 | Ho-Hsiang | |
| 8,054,155 | B2 | 11/2011 | Raczkowski | |
| 8,493,169 | B2 * | 7/2013 | Paek et al. | 336/200 |
| 2003/0001710 | A1 | 1/2003 | Tang et al. | |
| 2006/0044195 | A1 | 3/2006 | Arkko et al. | |
| 2006/0077028 | A1 | 4/2006 | Huang | |
| 2011/0018672 | A1 * | 1/2011 | Papananos | 336/200 |
| 2011/0163824 | A1 * | 7/2011 | Kawano | 333/17.3 |
| 2011/0241793 | A1 * | 10/2011 | Frye et al. | 333/25 |
| 2012/0223176 | A1 | 9/2012 | Papananos | |
| 2014/0077919 | A1 * | 3/2014 | Godoy et al. | 336/220 |

* cited by examiner

SECTION 3B-3B' OF FIGURE 4

SECONDARY COIL HAS LARGER DIAMETER

SECONDARY COIL
HAS LARGER
DIAMETER

SECONDARY COIL
HAS LARGER
DIAMETER

PRIMARY COIL HAS LARGER DIAMETER

PRIMARY COIL HAS LARGER DIAMETER

SECONDARY COIL
HAS LARGER DIAMETER

TRANSFORMER
BALUN 10E

PRIMARY COIL
HAS LARGER DIAMETER

INTEGRATED TRANSFORMER BALUN WITH ENHANCED COMMON-MODE REJECTION FOR RADIO FREQUENCY, MICROWAVE, AND MILLIMETER-WAVE INTEGRATED CIRCUITS

FIELD

The field of the invention relates to radio frequency, microwave, and millimeter-wave circuits used in communication, radar, and imaging systems.

BACKGROUND

Radio frequency, microwave, and millimeter-wave integrated circuits are essential to the functionality of wireless communication, radar, and imaging systems. Integrated circuit design at these frequencies requires the use of on-chip passive electrical components such as resistors, inductors, capacitors, and transformers. Transformers and balanced-to-unbalanced (balun) devices are commonly used in wireless communications. A transformer is commonly used to couple differential radio-frequency, microwave, or millimeter-wave frequency signals between functional circuit blocks. Baluns are used for single-ended to differential conversion or differential to single-ended conversion of signals. The effectiveness of this conversion should be maximized in a useful balun design to maximize the signal power in the desired mode, for example in differential-mode.

In single-ended to differential conversion, with one port grounded on the primary coil of a transformer balun, the ideal output on the secondary coil would be purely differential. Suppression of common-mode signals at the secondary coil terminals is important to maximize the signal power in the differential mode, and also to avoid common-mode variation in the operating point of the subsequent circuitry.

At high frequencies, the parasitic capacitance between transformer windings leads to undesirable common-mode output at the secondary coil when the balun is excited with a single-ended input at the first terminal of the primary coil and the second terminal of the primary coil is grounded. The complex impedance of this capacitance becomes small at high frequencies, causing capacitive coupling between turns of each coil to itself, and also between turns of the primary coil to the secondary coil. The primary coil is asymmetrically grounded, but the secondary coil is uniformly coupled to the primary coil, causing a degraded common-mode rejection due to this asymmetry.

The differential mode conversion gain is the ratio of the differential signal power at the transformer secondary to the single-ended signal power at the first terminal of the primary coil, where the second terminal is grounded. The common mode conversion gain is defined similarly, but relates to common mode signal power at the transformer secondary. The common mode rejection of the balun is defined as the ratio of the differential mode conversion gain to the common mode conversion gain. Maximizing the common mode rejection ratio (CMRR) is desirable since it means more of the input signal power is being converted to the desirable differential output signal, and less to the undesirable common-mode output signal at the transformer secondary coil.

SUMMARY

Apparatus and method example embodiments provide an improved transformer balun having a maximized common mode rejection ratio and improved self-resonant frequency due to a reduced need for capacitance added to the center-taps of the windings.

An example embodiment of the invention includes an apparatus comprising:

a first winding of at least one turn forming a primary coil, having first and second differential leads oriented in a first direction, the primary coil formed in a first conductive layer over a substrate and the first differential lead of the primary coil being grounded; and a second winding of at least one turn forming a secondary coil, having a third and fourth differential leads oriented in a second direction offset by an angle of greater than zero degrees and less than 180 degrees from the first direction, the secondary coil formed in a second conductive layer separated by an insulating layer from the first conductive layer;

wherein the primary coil and the secondary coil form a transformer balun.

An example embodiment of the invention includes an apparatus comprising:

wherein the primary coil has a different diameter than the secondary coil.

An example embodiment of the invention includes an apparatus comprising:

a center-tap of the secondary coil overlaps the grounded first differential lead of the primary coil; and the third and fourth differential leads of the secondary coil overlap the second differential lead of the primary coil.

An example embodiment of the invention includes an apparatus comprising:

a center-tap of the secondary coil overlaps the second differential lead of the primary coil; and the third and fourth differential leads of the secondary coil overlap the grounded first differential lead of the primary coil.

An example embodiment of the invention includes an apparatus comprising:

a center-tap of the primary coil overlaps the third differential lead of the secondary coil; and the grounded first and the second differential leads of the primary coil overlap the fourth differential lead of the secondary coil.

An example embodiment of the invention includes an apparatus comprising:

wherein the offset angle of greater than zero degrees and less than 180 degrees in the orientation of the primary and secondary coils, provides the third and fourth differential leads of the secondary coil with equivalent aggregate impedance, due to balanced capacitive and inductive coupling to the primary coil, thereby maximizing common mode rejection for the third and fourth differential leads of the secondary coil.

An example embodiment of the invention includes an apparatus comprising:

wherein the first and second leads of the primary coil are on the same side of the transformer balun as one another; and the third and fourth leads of the secondary coil are on the same side of the transformer balun as one another, reducing parasitic ground loop inductance between the leads of each pair.

An example embodiment of the invention includes a method comprising:

forming, with an apparatus, a primary coil of at least one turn in a first conductive layer over a substrate, the primary coil having first and second differential leads oriented in a first direction and the first differential lead of the primary coil being grounded; and forming, with an apparatus, a secondary coil of at least one turn in a second conductive layer separated by an insulating layer from the first conductive layer, the secondary coil having a third and fourth differential leads oriented in a second direction offset by an angle of greater than zero degrees and less than 180 degrees from the first direction;

wherein the primary coil and the secondary coil form a transformer balun.

An example embodiment of the invention includes a method comprising:

wherein the primary coil has a different diameter than the secondary coil.

An example embodiment of the invention includes a method comprising:

forming a center-tap of the secondary coil that overlaps the grounded first differential lead of the primary coil; and overlapping the third and fourth differential leads of the secondary coil with the second differential lead of the primary coil.

An example embodiment of the invention includes a method comprising:

forming a center-tap of the secondary coil that the second differential lead of the primary coil; and overlapping the third and fourth differential leads of the secondary coil with the grounded first differential lead of the primary coil.

An example embodiment of the invention includes a method comprising:

forming a center-tap of the primary coil that overlaps the third differential lead of the secondary coil; and overlapping the grounded first and the second differential leads of the primary coil with the fourth differential lead of the secondary coil.

An example embodiment of the invention includes a method comprising:

wherein the offset angle of greater than zero degrees and less than 180 degrees in the orientation of the primary and secondary coils, provides the third and fourth differential leads of the secondary coil with equivalent aggregate impedance, due to balanced capacitive and inductive coupling to the primary coil, thereby maximizing common mode rejection for the third and fourth differential leads of the secondary coil.

An example embodiment of the invention includes a method comprising:

wherein the first and second leads of the primary coil are on the same side of the transformer balun as one another; and the third and fourth leads of the secondary coil are on the same side of the transformer balun as one another, reducing parasitic ground loop inductance between the leads of each pair.

An example embodiment of the invention includes an apparatus comprising:

means for forming a primary coil of at least one turn in a first conductive layer over a substrate, the primary coil having first and second differential leads oriented in a first direction and the first differential lead of the primary coil being grounded; and means for forming a secondary coil of at least one turn in a second conductive layer separated by an insulating layer from the first conductive layer, the secondary coil having a third and fourth differential leads oriented in a second direction offset by an angle of greater than zero degrees and less than 180 degrees from the first direction;

wherein the primary coil and the secondary coil form a transformer balun.

An example embodiment of the invention includes an apparatus comprising:

wherein the primary coil has a different diameter than the secondary coil.

An example embodiment of the invention includes an apparatus comprising:

means for forming a center-tap of the secondary coil that overlaps the grounded first differential lead of the primary coil; and means for overlapping the third and fourth differential leads of the secondary coil with the second differential lead of the primary coil.

An example embodiment of the invention includes an apparatus comprising:

means for forming a center-tap of the secondary coil that the second differential lead of the primary coil; and means for overlapping the third and fourth differential leads of the secondary coil with the grounded first differential lead of the primary coil.

An example embodiment of the invention includes an apparatus comprising:

means for forming a center-tap of the primary coil that overlaps the third differential lead of the secondary coil; and means for overlapping the grounded first and the second differential leads of the primary coil with the fourth differential lead of the secondary coil.

An example embodiment of the invention includes an apparatus comprising:

wherein the offset angle of greater than zero degrees and less than 180 degrees in the orientation of the primary and secondary coils, provides the third and fourth differential leads of the secondary coil with equivalent aggregate impedance, due to balanced capacitive and inductive coupling to the primary coil, thereby maximizing common mode rejection for the third and fourth differential leads of the secondary coil.

An example embodiment of the invention includes an apparatus comprising:

wherein the first and second leads of the primary coil are on the same side of the transformer balun as one another; and the third and fourth leads of the secondary coil are on the same side of the transformer balun as one another, reducing parasitic ground loop inductance between the leads of each pair.

An example embodiment of the invention includes an apparatus comprising:

wherein the third and fourth differential leads of the secondary coil couple to similar regions of the primary coil and see approximately balanced impedances through capacitive and inductive coupling to the similar regions of the primary coil.

An example embodiment of the invention includes a method comprising:

wherein the third and fourth differential leads of the secondary coil couple to similar regions of the primary coil and see approximately balanced impedances through capacitive and inductive coupling to the similar regions of the primary coil.

The example embodiments of the invention provide an improved transformer balun having a maximized common mode rejection ratio and improved self-resonant frequency due to a reduced need for capacitance added to the center-taps of the windings.

DISCUSSION OF EXAMPLE EMBODIMENTS OF THE INVENTION

Figure 1:
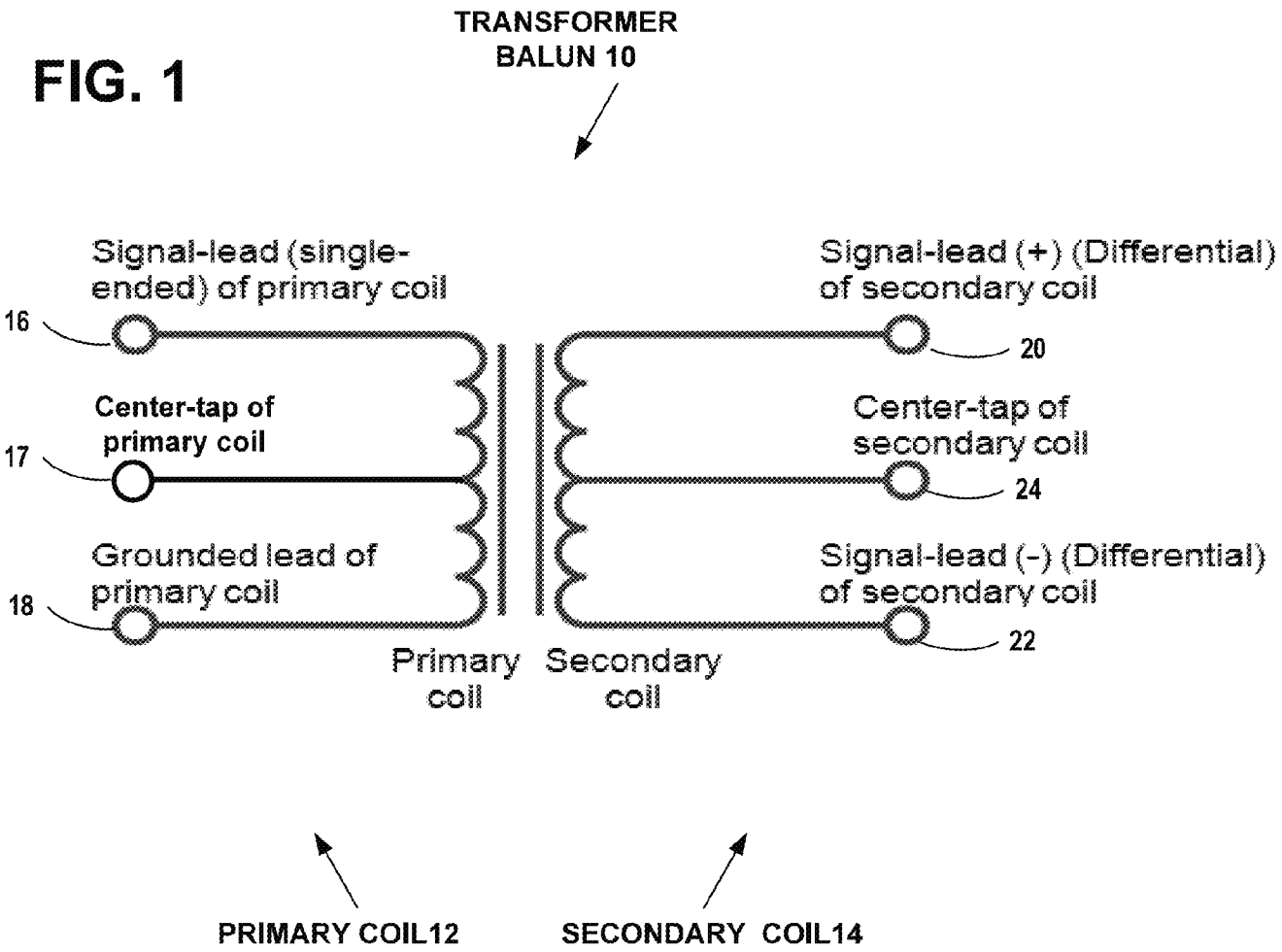
FIG. 1 illustrates an example embodiment of the invention, wherein a circuit diagram depicts an example transformer balun, with optional center-taps on either or both the primary and secondary coils to fine-tune the balance of the secondary coil's differential signal, in accordance with an example embodiment of the invention.

In accordance with an example embodiment of the invention, the common mode rejection of a transformer balun may be enhanced by orienting the leads of the primary and secondary coils at an angle greater than zero degrees and less than 180 degrees, for example at 90-degrees, to counteract the asymmetrical impedance of the primary coil which is capacitively and inductively coupled to the secondary coil. The self-resonant frequency of a transformer balun may also be enhanced by this method due to a reduced need for added capacitance at either or both center-taps of the primary and secondary coils. Intuitively, the improved common-mode rejection of the transformer balun—and the concomitant reduction in capacitance required on the transformer secondary to maximize the common-mode rejection—is due to the introduction of a rotational asymmetry between the primary and secondary coils. This rotational asymmetry seeks to counteract the impedance asymmetry in the primary coil.

To be compatible with manufacturing technology, integrated circuit design rules may restrict drawn shapes to having edges which are oriented 45 or 90 degrees with respect to the die edge, so the example embodiment discussed here selects a 90 degree relative orientation between primary and secondary coils. For the same reason, coils may be implemented as polygon approximations of a circle—for example being implemented as octagons—to conform to the design rules.

In accordance with an example embodiment of the invention, the two coils comprising the transformer balun may be offset by 90 degrees, so that the two leads of the secondary coil overlap portions of the primary coil, and the center-tap of the secondary coil overlaps a portion of the primary coil with a different impedance. For example, the center-tap of the secondary may overlap the "grounded lead" of the primary coil, while the two signal terminals of the secondary may overlap the "driven lead" of the primary coil. The reverse configuration is also possible. This may cause the two halves of the secondary coil to see a substantially similar impedance due to capacitive and inductive coupling to similar and equivalent-impedance regions of the primary coil, thereby enhancing the common-mode rejection of the balun Additionally, in accordance with an example embodiment of the invention, the secondary terminal spacing may be made small, so that the two secondary leads couple to the same region of the primary coil at their location of overlap and see approximately balanced impedances through this capacitive coupling with the primary coil.

The 90 degree difference in the orientation of the primary and secondary coils may provide an equivalent return-path inductance to both balanced leads of the balun in the 10 GHz-400 GHz frequency range where the effects of return-path inductance on circuit performance may be significant. Return-path inductance refers generally to all portions of the loop of current that are not along the coil itself but are instead in nearby conducting structures such as the ground plane or the other coil of the transformer. In the example embodiment, one segment of the primary may be substantially-grounded (impedance close to zero) and the other segment may have a higher apparent impedance due to the length of the primary coil and its associated inductance. Therefore, each half of the secondary coil has a segment which is parallel and coupled to the substantially-grounded segment of the primary coil, as well as a segment which is parallel and coupled to the higher-impedance segment of the primary coil. This similarity provides an intuitive understanding of the enhancement in common-mode rejection that the example embodiment provides, compared to previous transformer baluns.

Moreover, in accordance with an example embodiment of the invention, the differential leads of the secondary coil may be positioned on the same side of the transformer balun, reducing the parasitic (ground-loop) inductance between leads. Doing so reduces the dependence of the secondary coil's differential impedance on the size, shape, and proximity of the surrounding ground plane. Placing the leads close together may reduce the length of the return path and enable the balun to operate at higher frequencies. An added benefit may be that differential waveguides, for example differential microstrip or coplanar stripline waveguides, may be more easily connected to the transformer balun by virtue of the proximity of the differential leads.

Such an example embodiment of the invention serves to increase the common mode rejection ratio (CMRR) of the transformer balun, converting more of the input signal power to the desirable differential output signal. Moreover, an additional benefit may be that the capacitance required on the transformer secondary center-tap to maximize the common mode rejection ratio (CMRR) may be much smaller for the 90-degree transformer balun than for an alternate 180-degree transformer balun. This is because the angular orientation of leads of the example embodiment of the invention counteract the inherent asymmetry in the primary coil, which has one lead grounded and another driven by a nonzero source impedance. As a result, less additional capacitance is required to be added to the coils center tap(s).

In an example embodiment of the invention, the primary coil may be formed in a first conductive layer separated by an insulating layer from the secondary coil that is formed in a second conductive layer. High frequency signals applied to the leads of the primary coil produce a magnetic field that inductively couples with the secondary coil. The self-resonant frequency of the transformer balun must be sufficiently higher than the circuit operating frequency to achieve low loss. An example outer diameter for a transformer balun operating in a 94 GHz circuit has a secondary coil being on the order of 70 micrometers in diameter and the thickness of the insulating layer separating the two coils being on the order of one micrometer. The two coils of the transformer balun may be formed on different metal layers of a multilayer integrated circuit, to minimize capacitive coupling between the primary and secondary coils.

In an example alternate embodiment of the invention, the two coils comprising the transformer balun may be of different exterior diameter. This reduces the capacitive coupling between primary and secondary that occurs in a stacked configuration transformer balun where the primary and secondary coils are substantially the same size and shape but occupy different metal layers separated by an interlayer dielectric.

In still another example alternate embodiment of the invention, each coil may have a center tap where tuning capacitance may be placed to further improve the common-mode rejection of the transformer balun. Capacitance inherent to or explicitly added to either the primary or secondary coil's center-tap may be used to balance the differential output and improve the balun's CMRR. In particular, adding capacitance to the secondary may be very effective, and the 90-degree difference in the orientations of the coils in the balun requires less capacitance than do alternate parallel baluns having either no difference or a 180 degree difference in the orientations of the coils.

FIG. 1 illustrates an example embodiment of the invention, wherein a circuit diagram depicts an example transformer balun 10, with optional center-taps 17 and 24 on either or both the primary coil 12 and secondary coil 14 to fine-tune the balance of the secondary coil's differential signal, in accordance with an example embodiment of the invention. The primary coil may include the signal-lead 16, the grounded lead 18, and the optional center tap 17. The secondary coil may include a first differential signal lead 20, a second differential signal lead 22, and the optional center tap lead 24. The transformer balun 10 of FIG. 1 may be used to couple radio-frequency, microwave, or millimeter-wave frequency signals between functional circuit blocks, for single-ended to differential conversion. The transformer balun 10 may be used to convert between single-ended and differential signals or vice versa. In single-ended to differential conversion, one lead 18 is grounded on the primary coil 12 and the output signal on the secondary coil 14 is differential. It is a passive reciprocal network, so it does equally well at single-ended-to-differential conversion as it does in the other way around.

Figure 2:
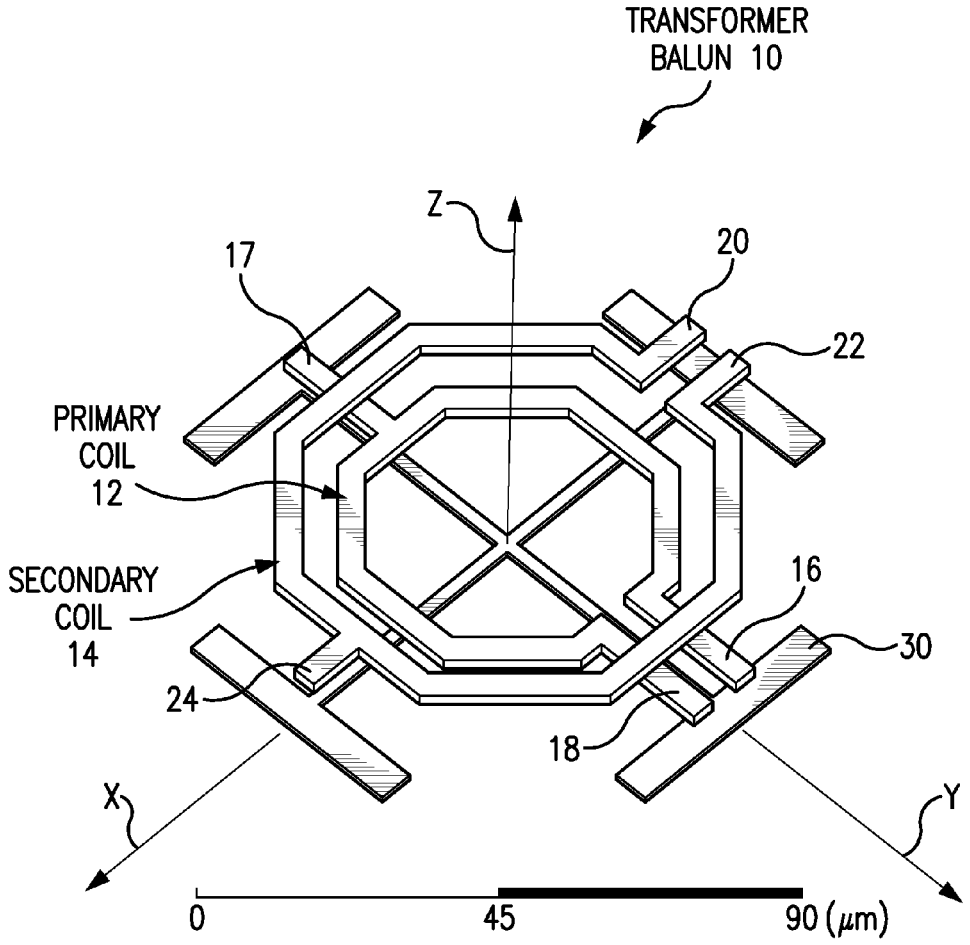
FIG. 2 illustrates an example embodiment of the invention, wherein a three-dimensional view depicts the example transformer balun with a single-turn primary coil and a single turn secondary coil, the primary coil having first and second differential leads oriented in a first direction with the first differential lead grounded, the primary coil being formed in a first conductive layer over a substrate, the secondary coil having a third and fourth differential leads oriented in a second direction offset by 90-degrees from the first direction, the secondary coil being formed in a second conductive layer separated by an insulating layer over the primary coil in the first conductive layer, in accordance with an example embodiment of the invention.

FIG. 2 illustrates an example embodiment of the invention, wherein a three-dimensional view in the X, Y and Z directions. The figure depicts the example transformer balun 10 with a single-turn primary coil 12 and a single turn secondary coil 14. The primary coil 12 has a first differential lead 18 and a second differential lead 16 oriented along a first direction Y, with the first differential lead 18 grounded. The primary coil 12 may be formed in a first conductive layer, such as copper, over a substrate, such as an insulating substrate of silicon dioxide and/or silicon nitride that, itself, may be on any number of other substrates such as silicon. The secondary coil 14 has a third differential lead 20 and a fourth differential lead 22 oriented along a second direction X that is offset by 90-degrees from the first direction Y. The secondary coil 14 may be formed in a second conductive layer, such as copper, separated by an insulating layer, such as silicon dioxide or silicon nitride, over the primary coil 12 in the first conductive layer, in accordance with an example embodiment of the invention. Alternately, the primary coil 12 may be on the upper metal layer and the secondary coil 14 may be on the lower metal layer.

The figure shows the two coils 12 and 14 of the transformer balun 10 may be of different exterior diameters. A reference rule shown in the figure is graduated at 45 and 90 micrometers, indicating that the diameter of the primary coil 12 is approximately 50 micrometers and the diameter of the secondary coil is approximately 70 micrometers. This may reduce the capacitive coupling between primary 12 and secondary 14 that could occur in a stacked configuration transformer balun where the primary and secondary coils would be substantially the same size and shape, but occupy different metal layers separated by an interlayer dielectric. The ground plane conductor 30, may be required for simulation, and may be typically included in practice, as well, for good matching between simulation and the fabricated device.

Figure 3A:
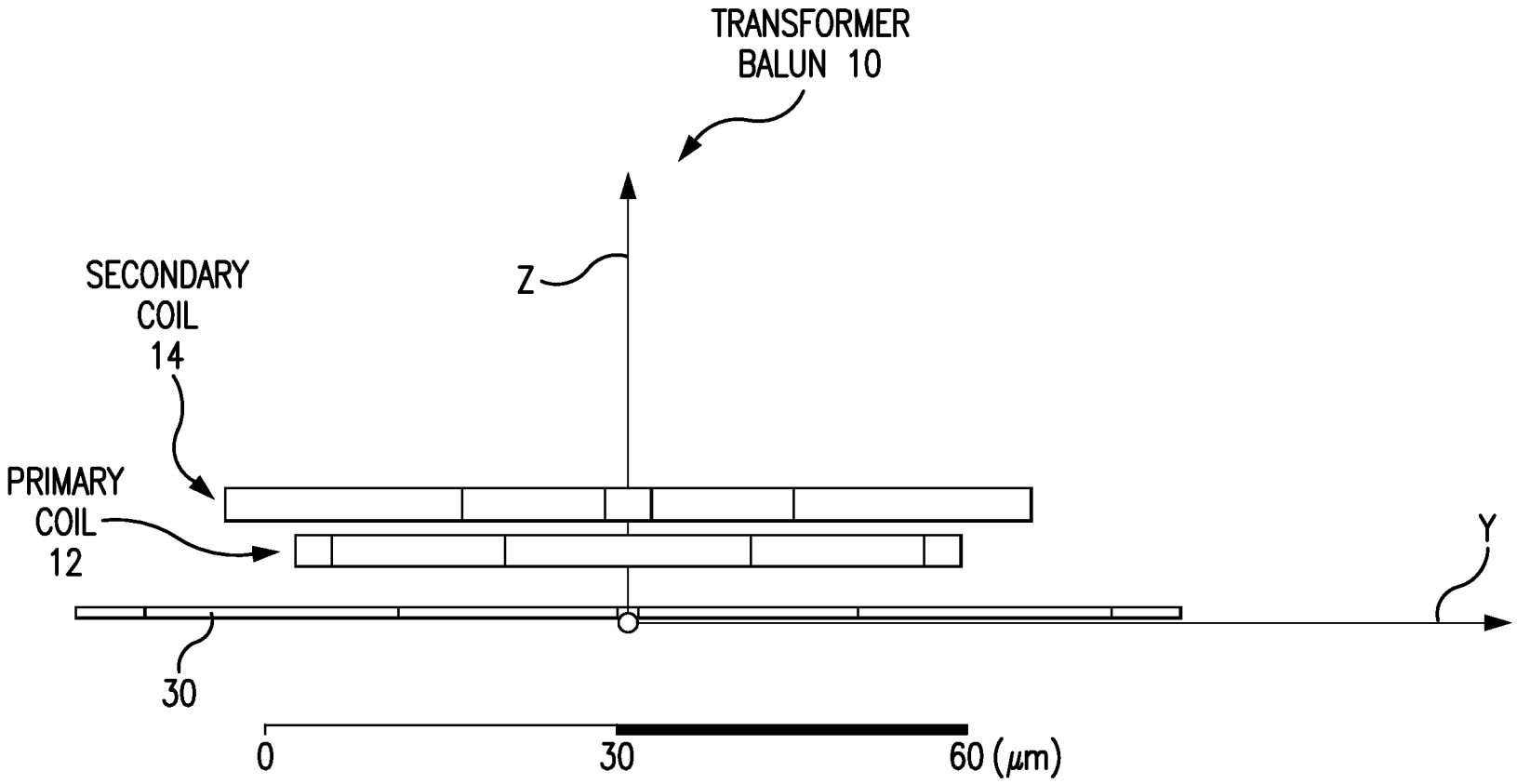
FIG. 3A illustrates an example embodiment of the invention, depicting a side view of the transformer balun of FIG. 2, showing the separation of the primary and secondary coils and the ground layer onto multiple layers, in accordance with an example embodiment of the invention.

FIG. 3A illustrates an example embodiment of the invention, depicting a side view of the transformer balun 10 of FIG. 2, showing the separation of the primary coil 12, secondary coil 14, and ground layer 30 onto multiple layers, in accordance with an example embodiment of the invention. The ground plane conductor 30, shown on a layer separated from and beneath the primary and secondary coils, may be required for simulation, and may be typically included in practice, as well, for good matching between simulation and the fabricated device. FIG. 3A is a simplified view and does not show insulating layers separating the conductive layers or the encapsulation of the conductors by insulating layers. A more detailed view of the transformer balun 10 structure is shown in FIG. 3B.

Figure 3B:
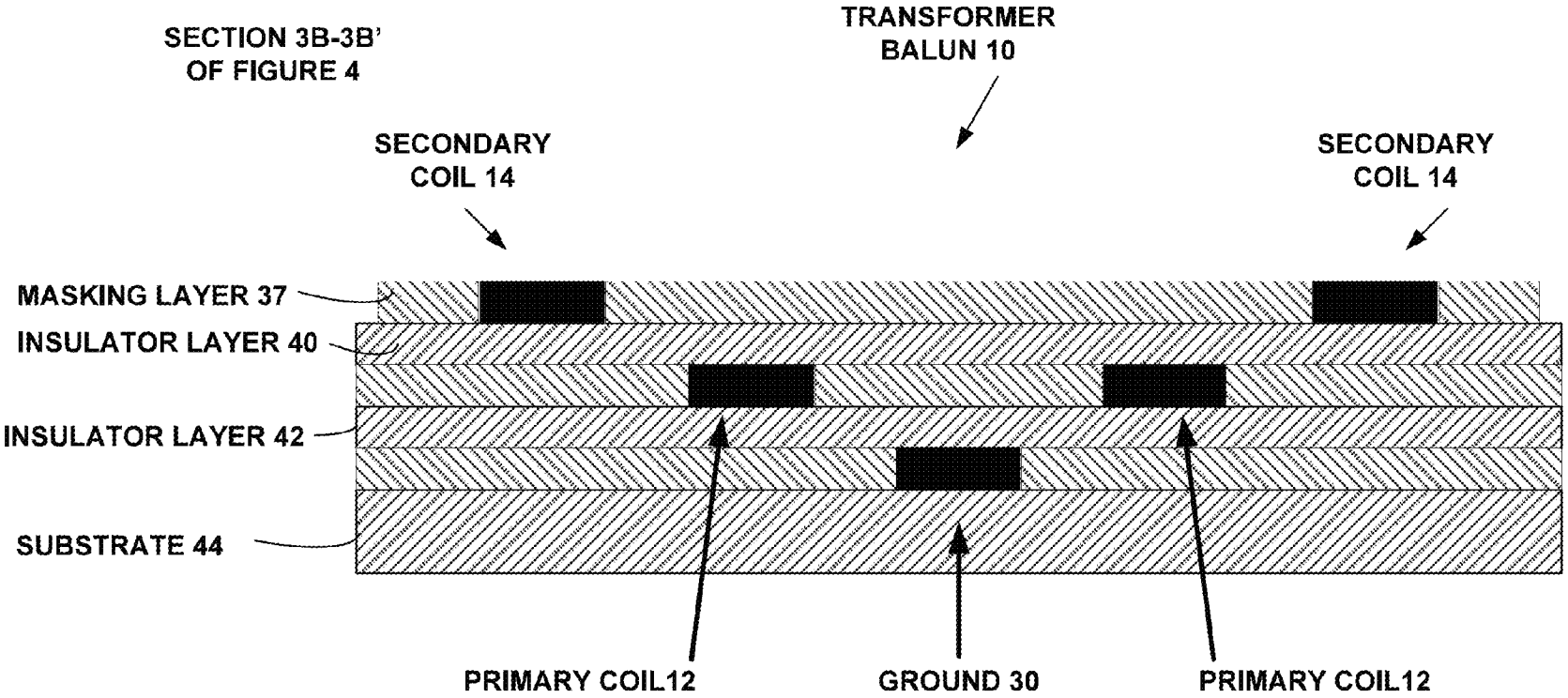
FIG. 3B illustrates an example embodiment of the invention, depicting a cross-sectional view along the section line 3B-3B' of FIG. 4, of the transformer balun of FIG. 2, showing the separation of the primary and secondary coils onto two separate conductive layers separated by one or more insulating dielectric layers, in accordance with an example embodiment of the invention.
Figure 4:
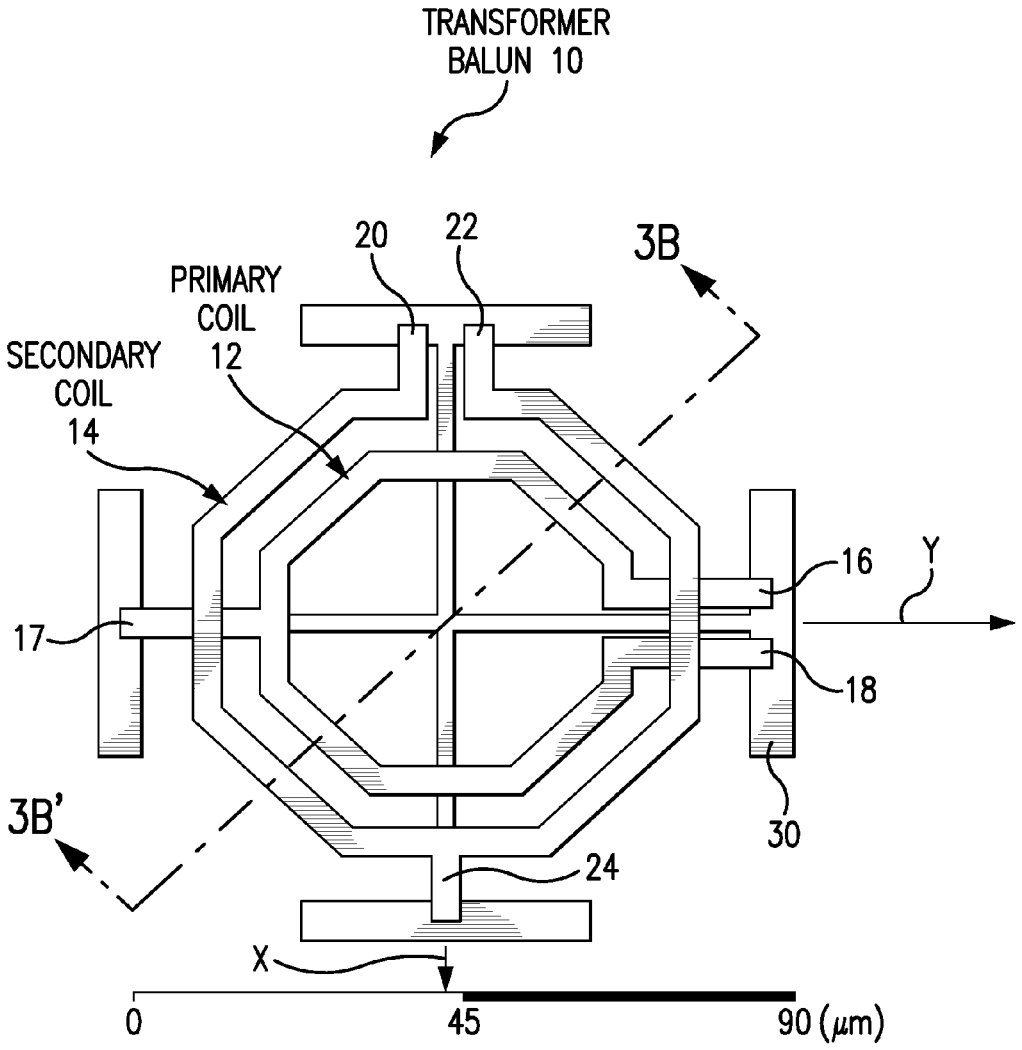
FIG. 4 illustrates an example embodiment of the invention, depicts a top view of the transformer-balun of FIG. 2, showing the difference in exterior width or diameter between the primary and secondary coils and showing the 90-degree difference in orientation of the two coils, in accordance with an example embodiment of the invention.

FIG. 3B illustrates an example embodiment of the invention, depicting a cross-sectional view along the section line 3B-3B' of FIG. 4, of the transformer balun 10 of FIG. 2, showing the separation of the primary coil 12 and secondary coil 14 onto two separate conductive layers separated by an insulating layer 40, in accordance with an example embodiment of the invention. The primary coil 12 may be formed in a first conductive layer, such as copper, over a substrate 44, such as an insulating substrate of silicon dioxide or silicon nitride. The secondary coil 14 may be formed in a second conductive layer, such as copper, separated by an insulating layer 40, such as silicon dioxide or silicon nitride, over the primary coil 12 in the first conductive layer, in accordance with an example embodiment of the invention. The optional ground plane conductor 30 is also shown in the figure on a layer separated by an insulator layer 42 from and beneath the primary coil 12. An insulating material encapsulates the metals on the sides. The insulating layer is not only sandwiched between the metals, but fully encapsulates the metal layers on their sides. The top metal may either be exposed to air or further encapsulated my any number of additional insulating layers (not shown in FIG. 3B). If the substrate is a semiconductor, such as silicon, then an insulating material may be positioned between the silicon substrate and the ground plane metal.

FIG. 4 illustrates an example embodiment of the invention, depicts a top view of the transformer-balun 10 of FIG. 2, showing the difference in exterior width or diameter between the primary coil 12 and secondary coil 14 and showing the 90-degree difference in orientation of the two coils along the respective Y and X directions, in accordance with an example embodiment of the invention. The X and Y directions are represented by mutually orthogonal axes in the figure, which intersect at a point of intersection which is also intersected by a Z axis that is mutually orthogonal with the X and Y axes. The primary coil 12 is a single winding of its conductor about the Z axis. The secondary coil 14 is a single winding of its conductor about the Z axis. The primary coil 12 and the secondary coil 14 are concentric with each other and have their centers coincident with the Z axis. The cross-sectional line 3B-3B' for the cross sectional view of FIG. 3B, is shown in relation to the primary and secondary coils of the transformer balun 10.

In accordance with an example embodiment of the invention, the following are example steps to design an example embodiment of the invention.

1) Design a first coil on metal layer (k) of dimension (d1).
   a. If multiple turns are used, implement underpasses or overpasses on metal layer (k−1) and/or (k+1).
2) Design a second coil on a different metal layer (m>k) of dimension (d2≠d1) such that the two coils do not overlap significantly by making the difference |d2−d1| sufficiently large.
   a. If multiple turns are used, implement underpasses or overpasses on metal layer (m−1) and/or (m+1).

3) Rotate one or both coils about their common central axis such that the two sets of differential leads are orthogonal. In other words, implement a 90-degree rotation between the primary and secondary.
4) Simulate and optionally add a center tap to at least one coil, typically starting with the secondary coil, providing some parasitic capacitance to that coil and providing a lead onto which explicit capacitance can be placed.
5) If necessary to meet common-mode rejection specifications, add explicit capacitance to the added center-tap(s) and tune each capacitance value to meet the common-mode rejection requirement under a bi-conjugate impedance match.

Figure 5:
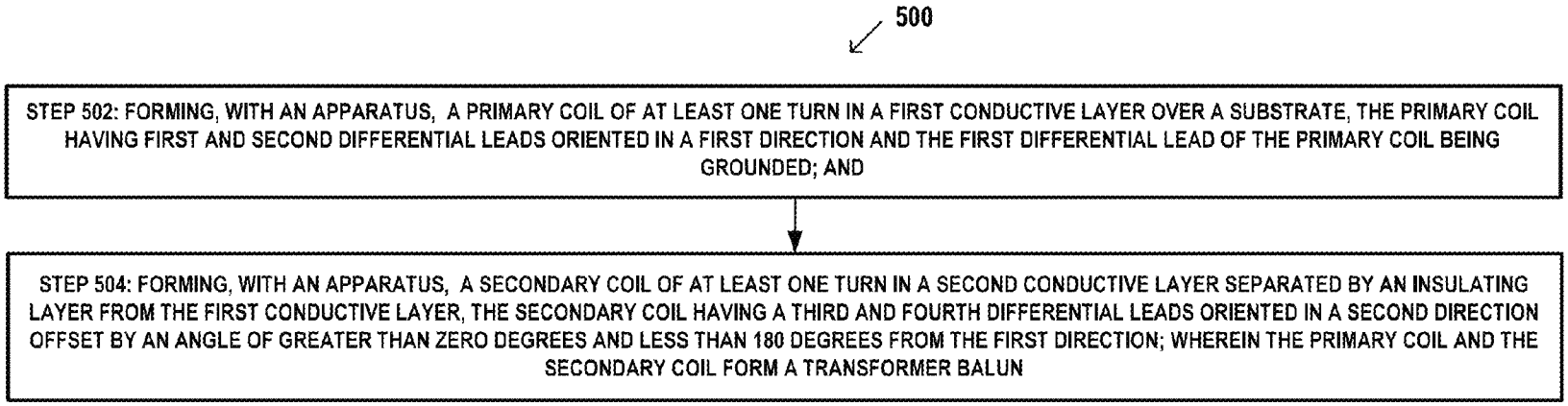
FIG. 5 is an example flow diagram of an example sequence of steps to manufacture an example embodiment of the invention, in accordance with an example embodiment of the invention.

FIG. 5 is an example flow diagram 500 of an example sequence of steps to manufacture an example embodiment of the invention, in accordance with an example embodiment of the invention. The steps of the flow diagram may be carried out in another order than shown and individual steps may be combined or separated into component steps. The flow diagram has the following steps:

Step 502: forming, with an apparatus, a primary coil of at least one turn in a first conductive layer over a substrate, the primary coil having first and second differential leads oriented in a first direction and the first differential lead of the primary coil being grounded; and Step 504: forming, with an apparatus, a secondary coil of at least one turn in a second conductive layer separated by an insulating layer from the first conductive layer, the secondary coil having a third and fourth differential leads oriented in a second direction offset by an angle of greater than zero degrees and less than 180 degrees from the first direction;

wherein the primary coil and the secondary coil form a transformer balun.

Figure 6:
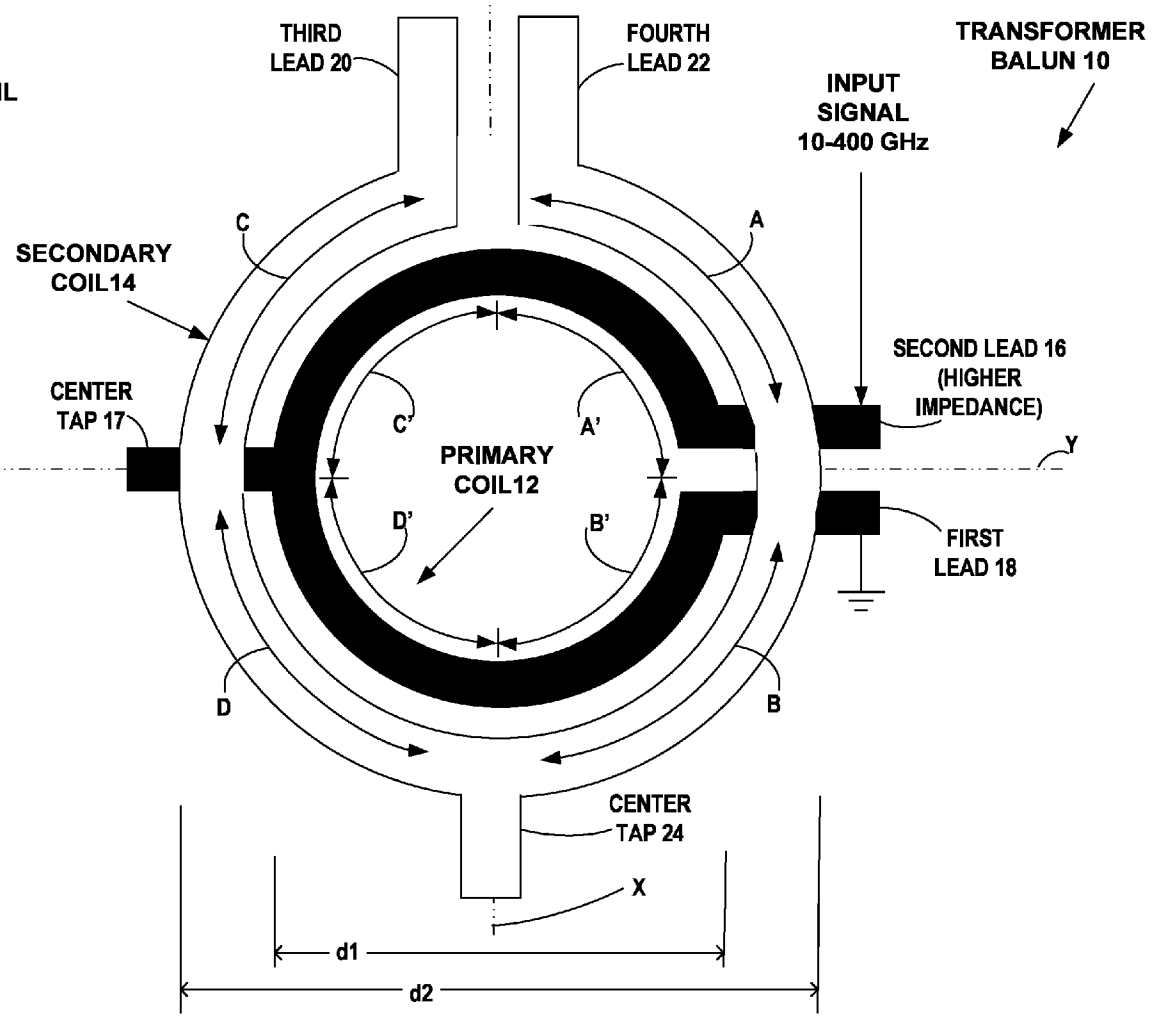
FIG. 6 illustrates an example embodiment of the invention, depicting a top view of the transformer-balun of FIG. 2, describing how the configuration of the primary and secondary coils form a transformer balun having a maximized common mode rejection ratio and improved self-resonant frequency due to a reduced need for capacitance added to the center-taps of the windings, in accordance with an example embodiment of the invention.

FIG. 6 illustrates an example embodiment of the invention, depicting a top view of the transformer-balun 10 of FIG. 2, describing how the configuration of the primary and secondary coils form a transformer balun having a maximized common mode rejection ratio and improved self-resonant frequency due to a reduced need for capacitance added to the center-taps of the windings.

The secondary coil 14 in this embodiment has a larger diameter "d2" than the primary coil 12 whose diameter is "d1", and the center-tap 17 of the primary coil 12 overlaps the third differential lead 20 of the secondary coil 14. The grounded first 18 and the second 16 differential leads of the primary coil 12 overlap the fourth differential lead 22 of the secondary coil 14. The secondary coil 14 is in the upper metal layer over the primary coil 12.

An explanation for why the present invention may enhance the common-mode rejection of previous transformer baluns follows; a significant performance enhancement has been demonstrated in full-wave electromagnetic simulations to support this explanation. Imagine each coil is cut in half into two "half-coils" along its axis of symmetry. The secondary coil 14 is shown with four segments, A, B, C, and D. For the secondary coil 14, the segments A and B form one half of the secondary coil 14 between the fourth lead 22 and the center tap 24. The segments C and D form the other half of the secondary coil 14 between the third lead 20 and the center tab 24. For the primary coil 12, the segments A' and C' form one half of the primary coil 12 between the driven second lead 16 and the center tap 17. The segments B' and D' form the other half of the primary coil 14 between the grounded first lead 18 and the center tab 17.

Suppose each half-coil is either substantially low-impedance (such as being grounded) or high-impedance (such as being connected to a 50 ohm line). In reality the impedance varies continuously along the conductor, so this is a simplification. The parallel segments on the primary coil 12 and the secondary coil 14 couple to each other capacitively and inductively. Using this simplified view, the primary coil 12 has one half-coil, the segments B' and D', that is substantially grounded and the other half-coil, the segments A' and C', that is a substantially higher impedance.

For the first half of the secondary coil 14, the segment B of the secondary coil 14 is parallel to the grounded segment B' of the primary coil 12 and the two segments couple to each other capacitively and inductively. The segment A of the secondary coil 14 is parallel to the driven segment A' of the primary and the two segments couple to each other capacitively and inductively. For the second half of the secondary coil 14, the segment D of the secondary coil 14 is parallel to the grounded segment D' of the primary coil 12 and couple to each other capacitively and inductively. The segment C of the secondary coil 14 is parallel to the driven segment C' of the primary coil 12 and couple to each other capacitively and inductively.

Since the parallel segments are coupled for both the high impedance and grounded segments in each half-coil of the secondary coil 14, the aggregate impedances in each half coil of the secondary coil 14 are substantially equivalent. It is this equivalence that maximizes the common mode rejection ratio and improves self-resonant frequency, due to a reduced need for capacitance added to the center-taps of the coils.

As stated, this half-coil argument is a simplification. Its accuracy may be improved by subdividing each coil into very small segments and defining an "apparent impedance" for each segment. Then the optimal design will seek to balance the sum of these impedances as seen from each geometric-half of the secondary coil. A generalization of this argument is that the 90-degree embodiment of the present invention is not necessarily the best, although it is better than a configuration using 0-degree or 180-degree designs. In practice, the optimal orientation will be some angle greater than zero degrees and less than 180 degrees, which balances the two half-coils of the secondary coil 14.

Figure 6B:
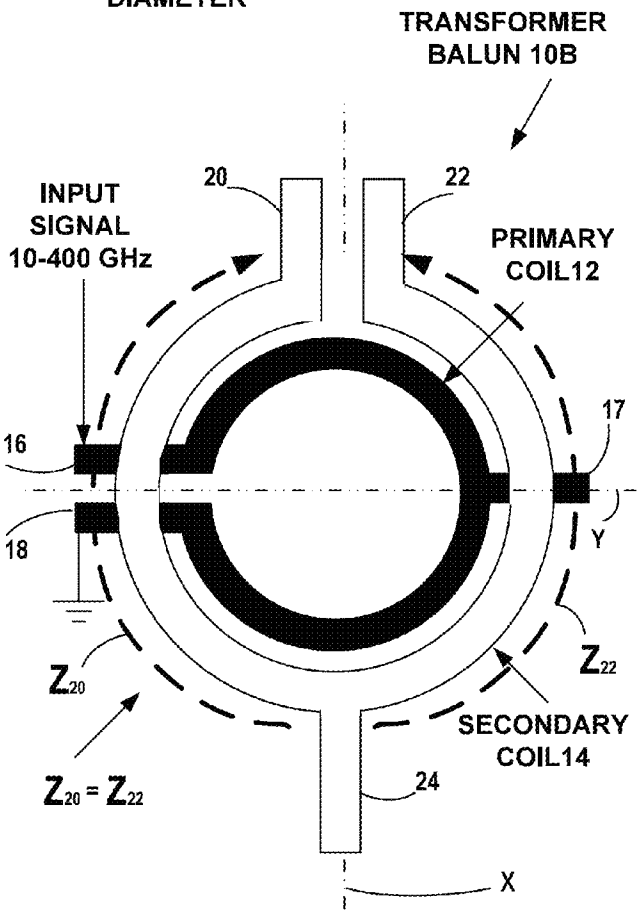
FIG. 6B illustrates an example embodiment of the invention, where the secondary coil of the transformer-balun has a larger diameter than the primary coil and they are offset by an angle of 90 degrees. The center-tap of the primary coil overlaps the fourth differential lead of the secondary coil. The grounded first and the driven second differential leads of the primary coil overlap the third differential lead of the secondary coil. In his configuration, the third and fourth differential leads of the secondary coil couple to similar regions of the primary coil and see approximately balanced impedances through capacitive and inductive coupling to the similar regions of the primary coil, in accordance with an example embodiment of the invention.
Figure 6A:
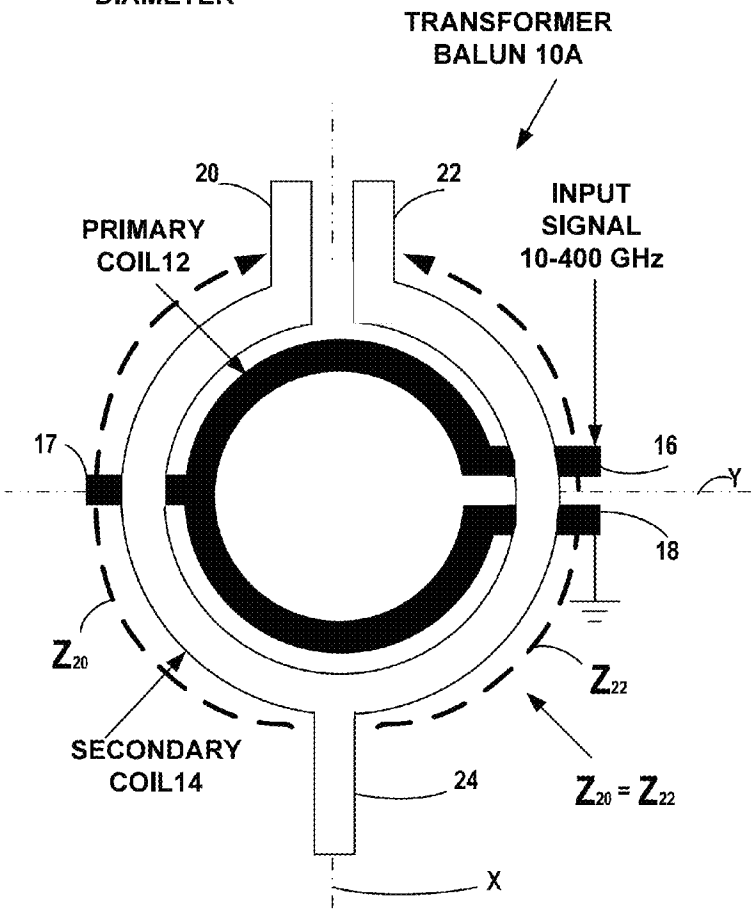
FIG. 6A illustrates an example embodiment of the invention, where the secondary coil of the transformer-balun has a larger diameter than the primary coil and they are offset by an angle of 90 degrees. The center-tap of the primary coil overlaps the third differential lead of the secondary coil. The grounded first and the driven second differential leads of the primary coil overlap the fourth differential lead of the secondary coil. In his configuration, the third and fourth differential leads of the secondary coil couple to similar regions of the primary coil and see approximately balanced impedances through capacitive and inductive coupling to the similar regions of the primary coil, in accordance with an example embodiment of the invention.

FIG. 6A illustrates an example embodiment of the invention, where the secondary coil 14 of the transformer-balun 10A has a larger diameter than the primary coil 12 and they are offset by an angle of 90 degrees. The secondary coil 14 is in the upper metal layer over the primary coil 12. The center-tap 17 of the primary coil 12 overlaps the third differential lead 20 of the secondary coil 14. The grounded first 18 and the driven second 16 differential leads of the primary coil 12 overlap the fourth differential lead 22 of the secondary coil 14. In this configuration, the third and fourth differential leads 20 and 22 of the secondary coil 14 couple to similar regions of the primary coil 12 and see approximately balanced impedances $Z_{20}$ and $Z_{22}$ through capacitive and inductive coupling to the similar regions of the primary coil 12, as illustrated in FIG. 6, in accordance with an example embodiment of the invention.

FIG. 6B illustrates an example embodiment of the invention, where the secondary coil 14 of the transformer-balun 10B has a larger diameter than the primary coil 12 and they are offset by an angle of 90 degrees. The secondary coil 14 is in the upper metal layer over the primary coil 12. The center-tap 17 of the primary coil 12 overlaps the fourth differential lead 22 of the secondary coil 14. The grounded first 18 and the driven second 16 differential leads of the primary coil 12 overlap the third differential lead 20 of the secondary coil 14. In this configuration, the third and fourth differential leads 20 and 22 of the secondary coil 14 couple to similar regions of the primary coil 12 and see approximately balanced impedances $Z_{20}$ and $Z_{22}$ through capacitive and inductive coupling to the similar regions of the primary coil 12, as illustrated in FIG. 6, in accordance with an example embodiment of the invention.

Figure 6D:
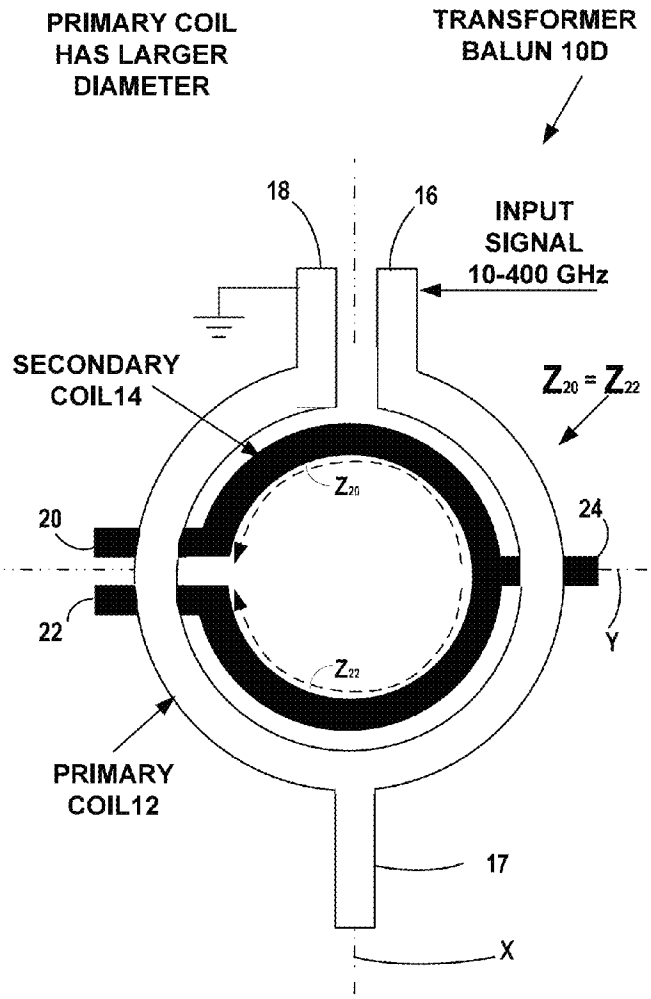
FIG. 6D illustrates an alternate example embodiment of the invention, where the primary coil has a larger diameter than the secondary coil and they are offset by an angle of 90 degrees. The figure shows a center-tap of the secondary coil overlaps the driven second differential lead of the primary coil. The third and fourth differential leads of the secondary coil overlap the grounded first differential lead of the primary coil. In his configuration, the third and fourth differential leads of the secondary coil couple to similar regions of the primary coil and see approximately balanced impedances through capacitive and inductive coupling to the similar regions of the primary coil, in accordance with an example embodiment of the invention.
Figure 6C:
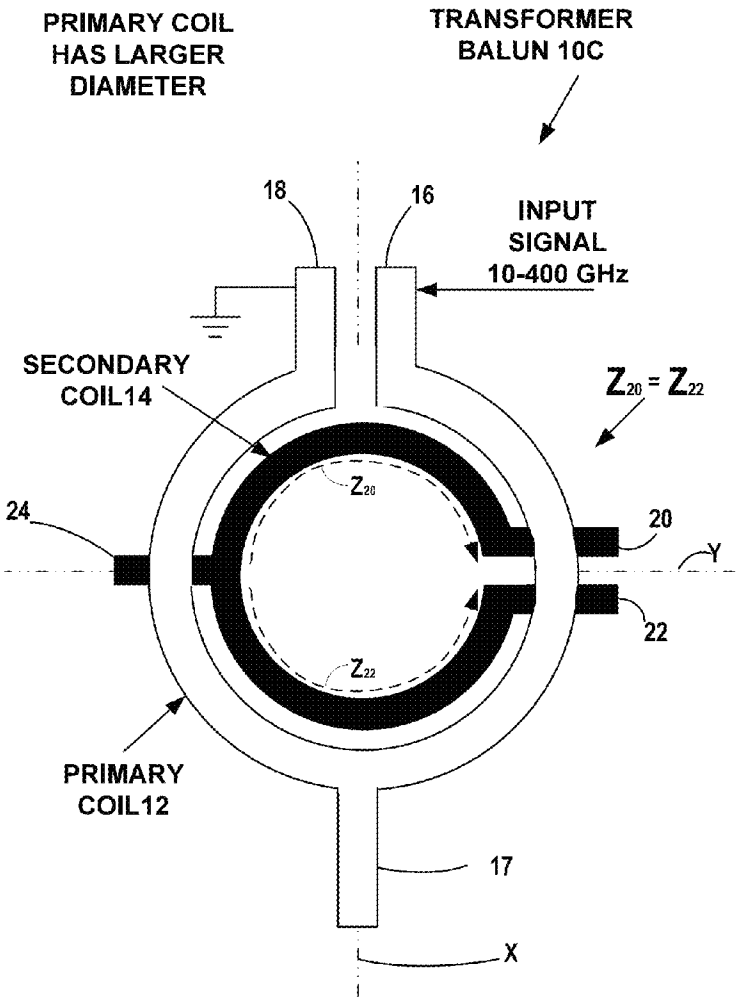
FIG. 6C illustrates an alternate example embodiment of the invention, where the primary coil has a larger diameter than the secondary coil and they are offset by an angle of 90 degrees. The figure shows a center-tap of the secondary coil overlaps the grounded first differential lead of the primary coil. The third and fourth differential leads of the secondary coil overlap the driven second differential lead of the primary coil. In his configuration, the third and fourth differential leads of the secondary coil couple to similar regions of the primary coil and see approximately balanced impedances through capacitive and inductive coupling to the similar regions of the primary coil, in accordance with an example embodiment of the invention.

FIG. 6C illustrates an alternate example embodiment of the invention, where the primary coil 12 of the transformer balun 10C has a larger diameter than the secondary coil 14 and they are offset by an angle of 90 degrees. The primary coil 12 is in the upper metal layer over the secondary coil 14. The figure shows a center-tap 24 of the secondary coil 14 overlaps the grounded first differential lead 18 of the primary coil 12. The third and fourth differential leads 20 and 22 of the secondary coil 14 overlap the driven second differential lead 16 of the primary coil 12. In this configuration, the third and fourth differential leads 20 and 22 of the secondary coil 14 couple to similar regions of the primary coil 12 and see approximately balanced impedances $Z_{20}$ and $Z_{22}$ through capacitive and inductive coupling to the similar regions of the primary coil 12, similar to that illustrated in FIG. 6, in accordance with an example embodiment of the invention.

FIG. 6D illustrates an alternate example embodiment of the invention, where the primary coil 12 of the transformer balun 10D has a larger diameter than the secondary coil 14 and they are offset by an angle of 90 degrees. The primary coil 12 is in the upper metal layer over the secondary coil 14. The figure shows a center-tap 24 of the secondary coil 14 overlaps the driven second differential lead 16 of the primary coil 12. The third and fourth differential leads 20 and 22 of the secondary coil 14 overlap the grounded first differential lead 18 of the primary coil 12. In this configuration, the third and fourth differential leads 20 and 22 of the secondary coil 14 couple to similar regions of the primary coil 12 and see approximately balanced impedances $Z_{20}$ and $Z_{22}$ through capacitive and inductive coupling to the similar regions of the primary coil 12, similar to that illustrated in FIG. 6, in accordance with an example embodiment of the invention.

Figure 6E:
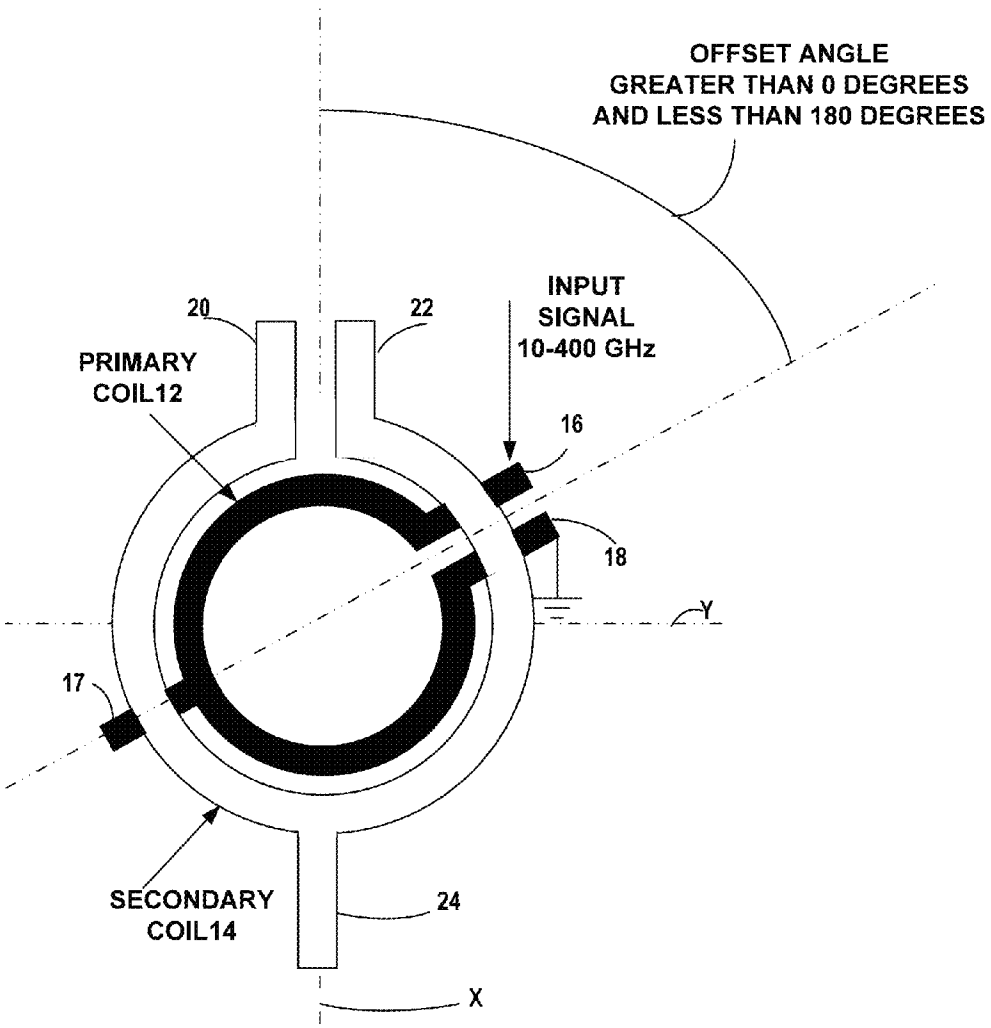
FIG. 6E illustrates an example embodiment of the invention, where the secondary coil of the transformer-balun has a larger diameter than the primary coil and they are offset by an angle of greater than zero degrees and less than 180 degrees. The center-tap of the primary coil overlaps the third differential lead of the secondary coil. The grounded first and the driven second differential leads of the primary coil overlap the fourth differential lead of the secondary coil. In his configuration, the third and fourth differential leads of the secondary coil couple to similar regions of the primary coil and see approximately balanced impedances through capacitive and inductive coupling to the similar regions of the primary coil, in accordance with an example embodiment of the invention.

FIG. 6E illustrates an example embodiment of the invention, where the secondary coil 14 of the transformer-balun 10E has a larger diameter than the primary coil 12 and they are offset by an angle of greater than zero degrees and less that 180 degrees. The secondary coil 14 is in the upper metal layer over the primary coil 12. The center-tap 17 of the primary coil 12 overlaps the third differential lead 20 of the secondary coil 14. The grounded first 18 and the driven second 16 differential leads of the primary coil 12 overlap the fourth differential lead 22 of the secondary coil 14. In this configuration, the third and fourth differential leads 20 and 22 of the secondary coil 14 couple to similar regions of the primary coil 12 and see approximately balanced impedances through capacitive and inductive coupling to the similar regions of the primary coil 12, as illustrated in FIG. 6, in accordance with an example embodiment of the invention.

Figure 6F:
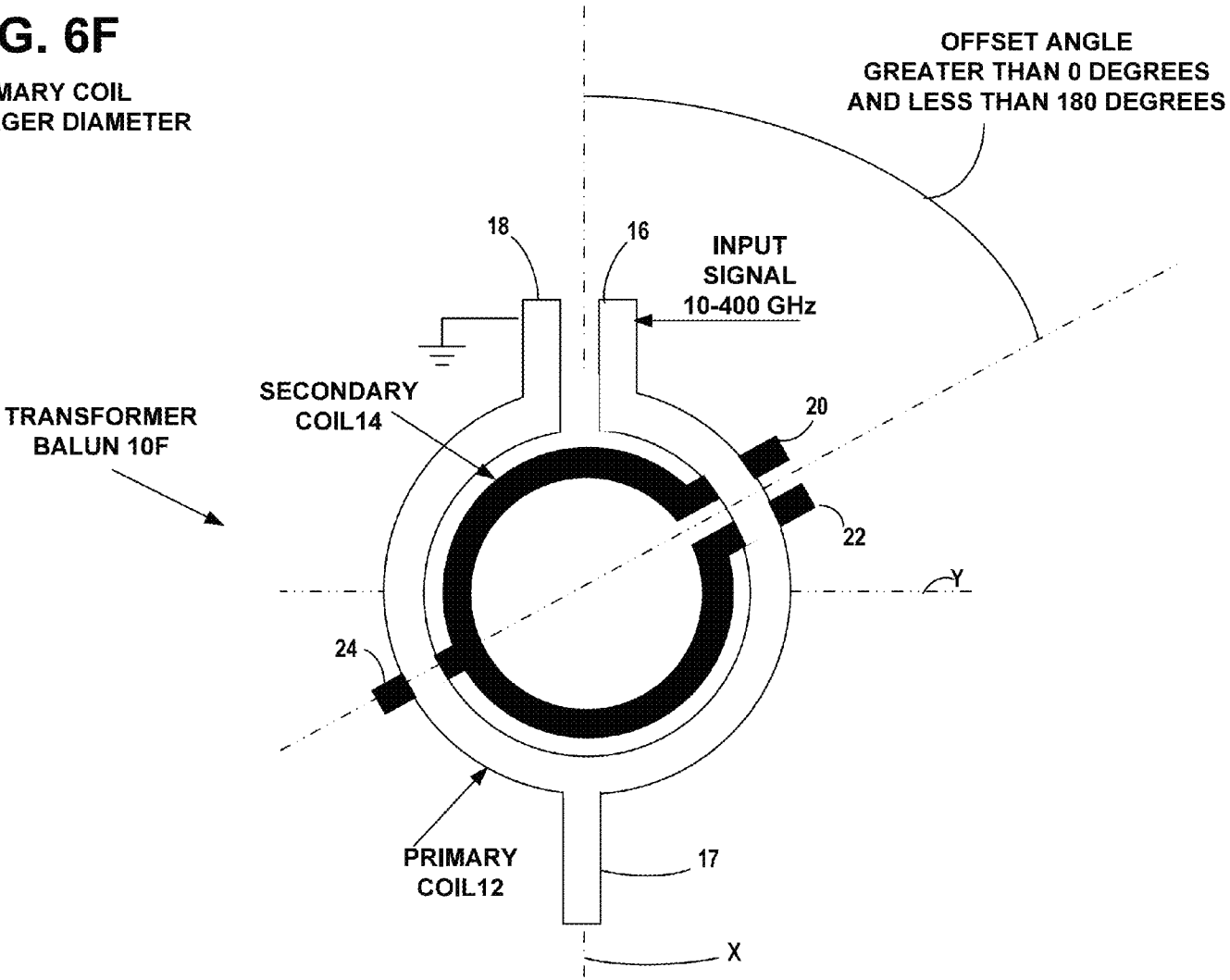
FIG. 6F illustrates an alternate example embodiment of the invention, where the primary coil has a larger diameter than the secondary coil and they are offset by an angle of greater than zero degrees and less than 180 degrees. The figure shows a center-tap of the secondary coil overlaps the grounded first differential lead of the primary coil. The third and fourth differential leads of the secondary coil overlap the driven second differential lead of the primary coil. In his configuration, the third and fourth differential leads of the secondary coil couple to similar regions of the primary coil and see approximately balanced impedances through capacitive and inductive coupling to the similar regions of the primary coil, in accordance with an example embodiment of the invention.

FIG. 6F illustrates an alternate example embodiment of the invention, where the primary coil 12 of the transformer balun 1 OF has a larger diameter than the secondary coil 14 and they are offset by an angle of greater than zero degrees and less that 180 degrees. The primary coil 12 is in the upper metal layer over the secondary coil 14. The figure shows a center-tap 24 of the secondary coil 14 overlaps the grounded first differential lead 18 of the primary coil 12. The third and fourth differential leads 20 and 22 of the secondary coil 14 overlap the driven second differential lead 16 of the primary coil 12. In this configuration, the third and fourth differential leads 20 and 22 of the secondary coil 14 couple to similar regions of the primary coil 12 and see approximately balanced impedances through capacitive and inductive coupling to the similar regions of the primary coil 12, similar to that illustrated in FIG. 6, in accordance with an example embodiment of the invention.

Integrated circuit mask fabrication processes may enforce layout rules requiring conductor edges to be oriented in angular increments of some value greater than 0 and less than 180 degrees with respect to die or mask edges. For example, some integrated circuit mask fabrication processes may allow a minimum-angular increment of 45-degrees, enabling the formation of octagonal coils seen in transformer balun 10 of FIG. 4. Other integrated circuit mask fabrication processes may allow smaller angular increments, allowing coils to approximate the circular shapes of transformer baluns 10, 10A, 10B, 10C, 10D, 10E, or 10F. Accordingly, the transformer baluns 10E and 10F, such as are depicted in FIGS. 6E and 6F, are constrained by the fabrication process to have the relative angular orientation of their primary and secondary coils' leads on the permissible angular grid.

The apparent impedance that each coil segment sees is primarily due to capacitive and magnetic coupling to the opposite coil segment. The mutual inductance is the same in both directions, independent of whether the coil is the larger or the smaller one. However, the capacitance of a coil with respect to the substrate depends on the size of the coil and how close it is the substrate, and therefore placing the smaller coil on the lower metal layer so that it has less area and therefore less capacitance to the substrate, may have the beneficial effect of raising the self-resonant frequency of the transformer balun, compared to placing the larger coil closer to the substrate. This may be particularly important when semiconductor (such as silicon) or low-resistance substrates are used. It may be beneficial to not make the two coils the same size, since then they would have a larger capacitance to each other, having the detrimental effect of lowering the self-resonant frequency of the transformer balun, as well as degrading the common-mode rejection of the transformer balun.

It may be convenient to use the upper metal layer as the secondary coil, to enable an easier connection to a differential waveguide on the uppermost metal layer. Similarly, it may be convenient to implement the single-ended primary coil on the lower metal layer, since one of its leads needs to be grounded, and it is then in closer proximity to the lower metal layers were ground planes are commonly implemented on an integrated circuit, allowing a shorter connection to the grounded lead of the coil.

Figure 7A:
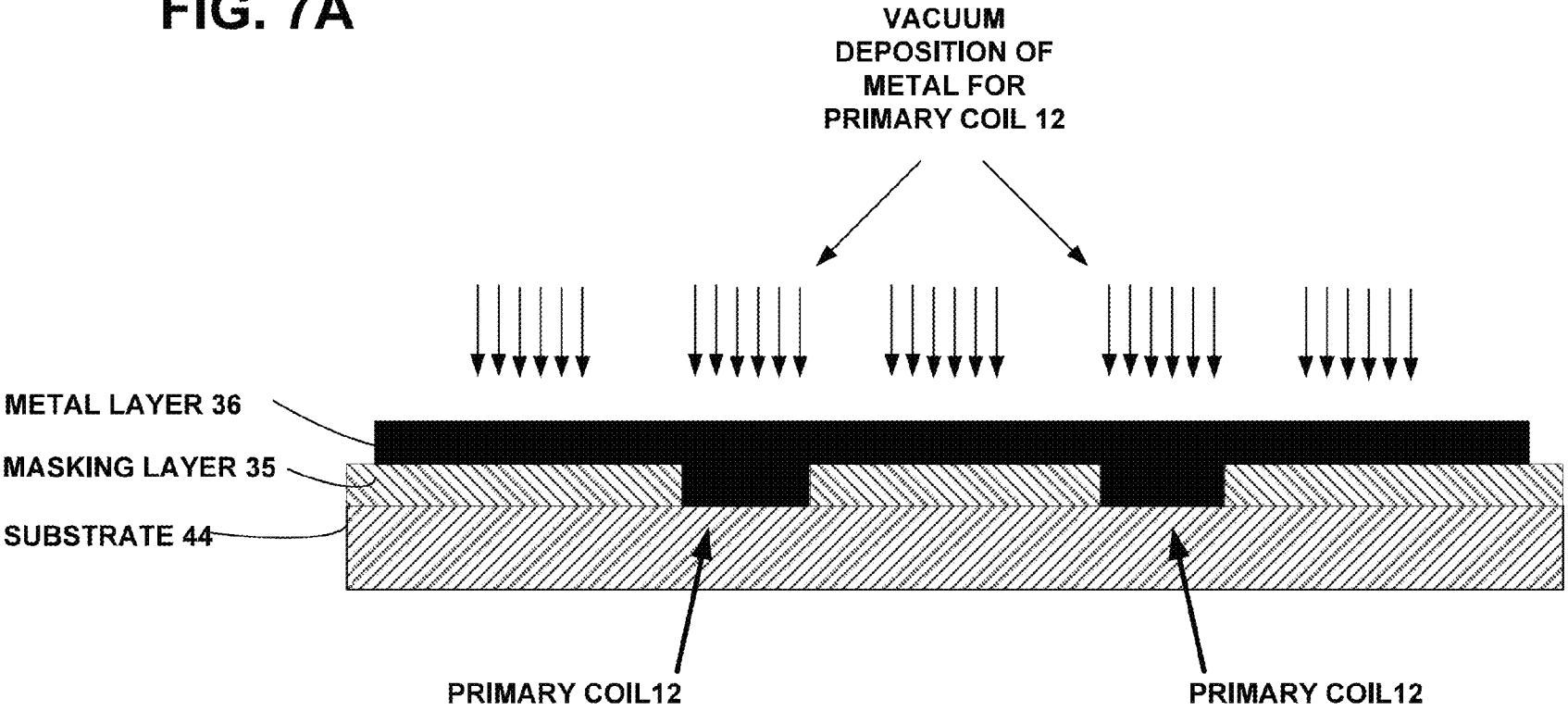
FIG. 7A illustrates an example embodiment of the invention, depicting a first stage in the fabrication of the transformer balun, wherein a masking layer may be deposited on the surface of the substrate, leaving apertures for the deposition of a metal layer forming the primary coil, in accordance with an example embodiment of the invention.

FIG. 7A illustrates an example embodiment of the invention, depicting a first stage in the fabrication of the transformer balun 10, wherein a masking layer 35, for example a layer of silicon dioxide, may be deposited on the surface of the substrate 44, and apertures may be etched therein for the deposition of a metal layer 36 forming the primary coil 12. The metal deposition process may be by vacuum deposition of a metal, such as copper, in a vacuum chamber, depositing a metal layer 36 on the surface of the masking layer 35 and the portions of the substrate surface exposed through the apertures in the masking layer 35. The metal layer 36 and masking layer 35 may then be planarized by chemical/mechanical polishing, leaving the primary coil 12 in the apertures of the masking layer 36 on the surface of the substrate. The primary coil 12 may be formed of at least one turn in the metal layer 36 over the substrate 44. The apertures in the masking layer 35 may be positioned to orient the first and second differential leads 16 and 18 of the primary coil 12 in a first direction Y, as shown in FIG. 2. An example diameter of the primary coil 12 formed by the apertures in the masking layer 35, may be approximately 50 micrometers.

Figure 7B:
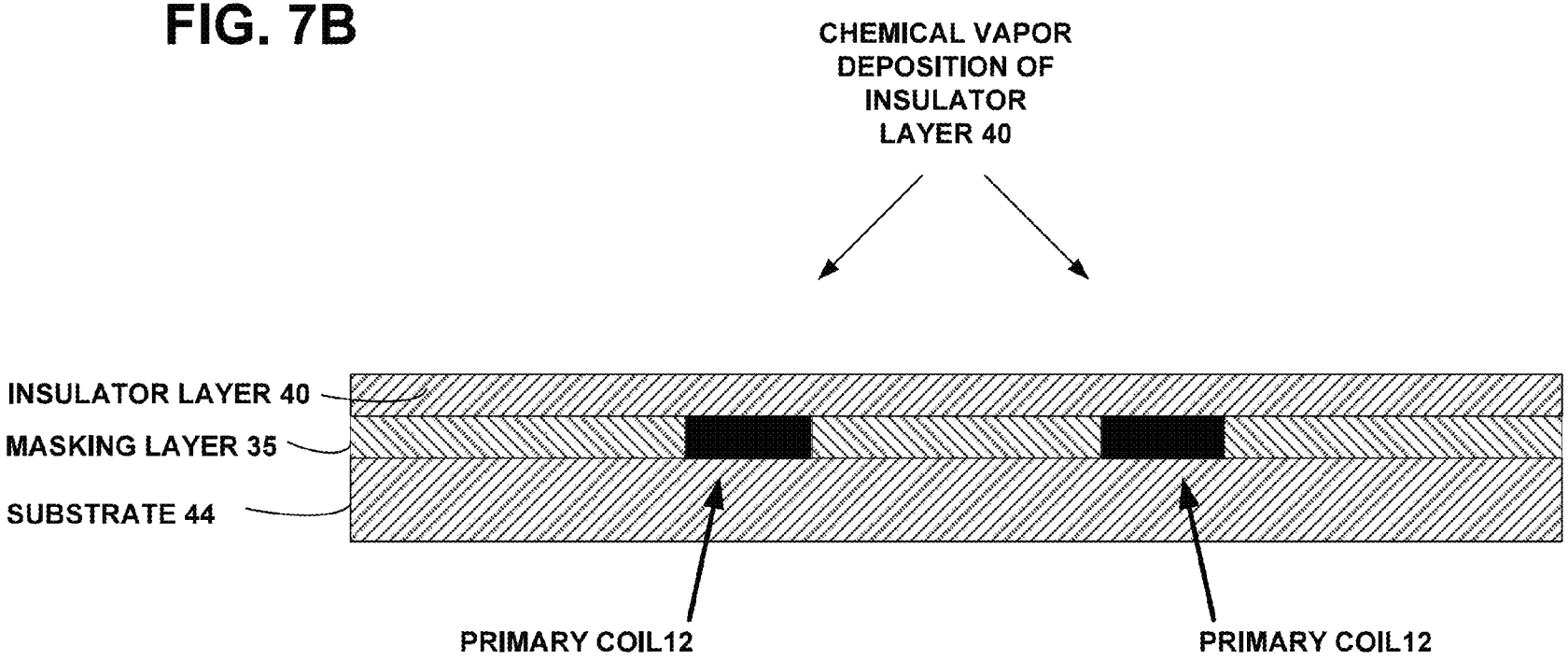
FIG. 7B illustrates an example embodiment of the invention, depicting a second stage in the fabrication of the transformer balun, wherein an insulator layer may be deposited on the surface of the substrate and over the primary coil on the surface of the substrate, in accordance with an example embodiment of the invention.

FIG. 7B illustrates an example embodiment of the invention, depicting a second stage in the fabrication of the transformer balun 10, wherein an insulator layer 40 may be deposited on the planarized surface of the masking layer 35 and over the exposed metal surface of the primary coil 12. The deposition process for the insulator 40 may be by chemical vapor deposition of silicon dioxide or other insulating material(s) in a deposition chamber, depositing a silicon dioxide layer on the planarized surface of the masking layer 35 and over the exposed metal surface of the primary coil 12. The thickness of the insulator layer 40 over the top of the primary coil 12 may be on the order of one micrometer.

Figure 7C:
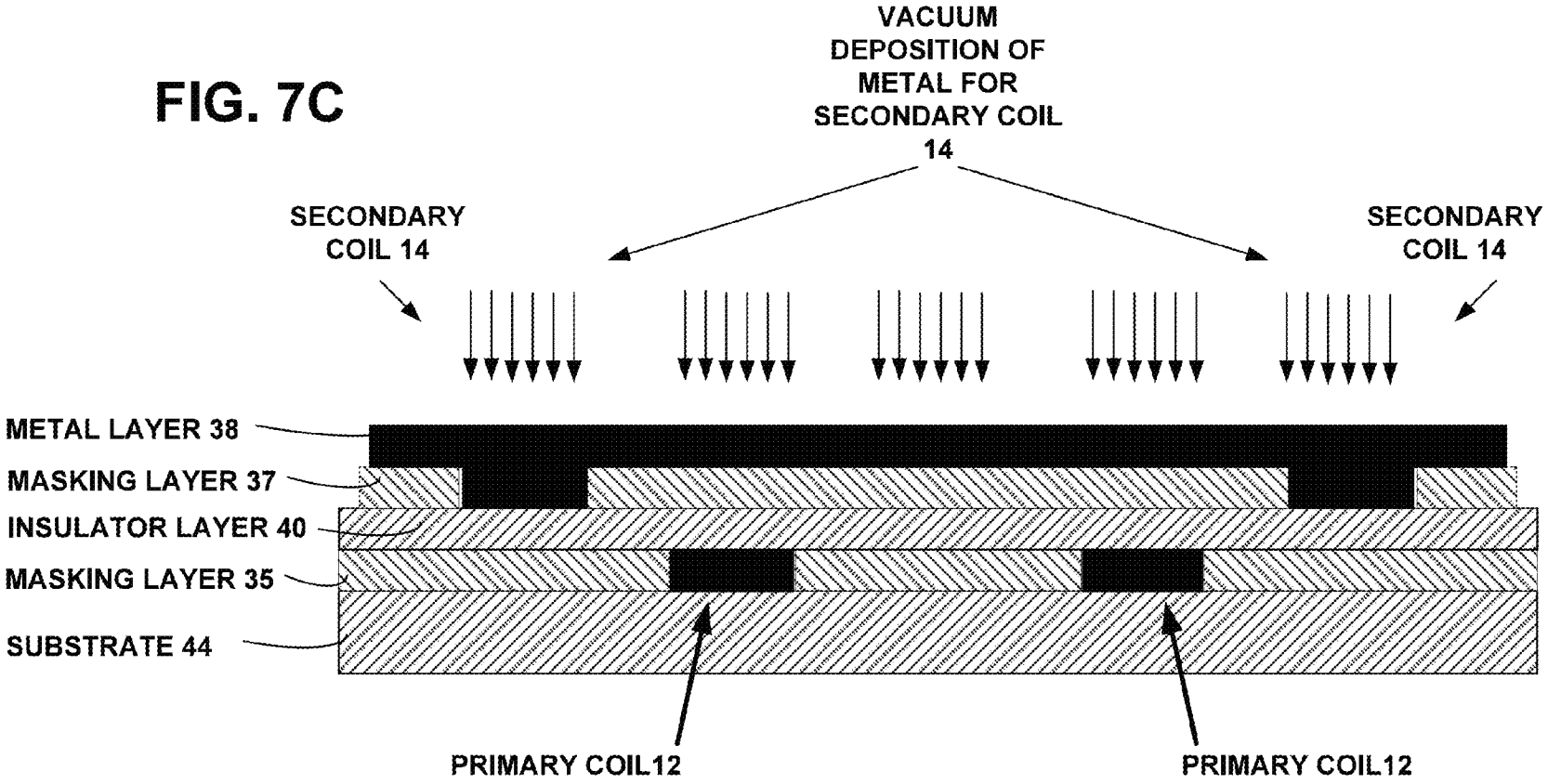
FIG. 7C illustrates an example embodiment of the invention, depicting a third stage in the fabrication of the transformer balun, wherein a masking layer may be deposited on the surface of the insulator layer, leaving apertures for the deposition of a metal layer forming the secondary coil, in accordance with an example embodiment of the invention.

FIG. 7C illustrates an example embodiment of the invention, depicting a third stage in the fabrication of the transformer balun 10, wherein a masking layer 37, for example a layer of silicon dioxide or other insulating material(s), may be deposited on the surface of the insulator layer 40, and apertures may be etched therein for the deposition of a metal layer 38 forming the secondary coil 14. The metal deposition process may be by vacuum deposition of a metal, such as copper, in a vacuum chamber, depositing the metal layer 38 on the surface of the masking layer 37 and the portions of the insulator layer 40 exposed through the apertures in the masking layer 37. The metal layer 38 and masking layer 37 may then be planarized by chemical/mechanical polishing, leaving the secondary coil 14 in the apertures of the masking layer 37 on the surface of the insulator layer 40. The secondary coil 14 may be formed of at least one turn in the metal layer 38 over the insulator layer 40. The apertures in the masking layer 37 may be positioned to orient the third and fourth differential leads 20 and 22 of the secondary coil 14 in a second direction X, offset by an angle of 90-degrees from the first direction Y, as shown in FIG. 2. An example diameter of the secondary coil 14 formed by the apertures in the masking layer 37, may be approximately 70 micrometers.

Figure 7D:
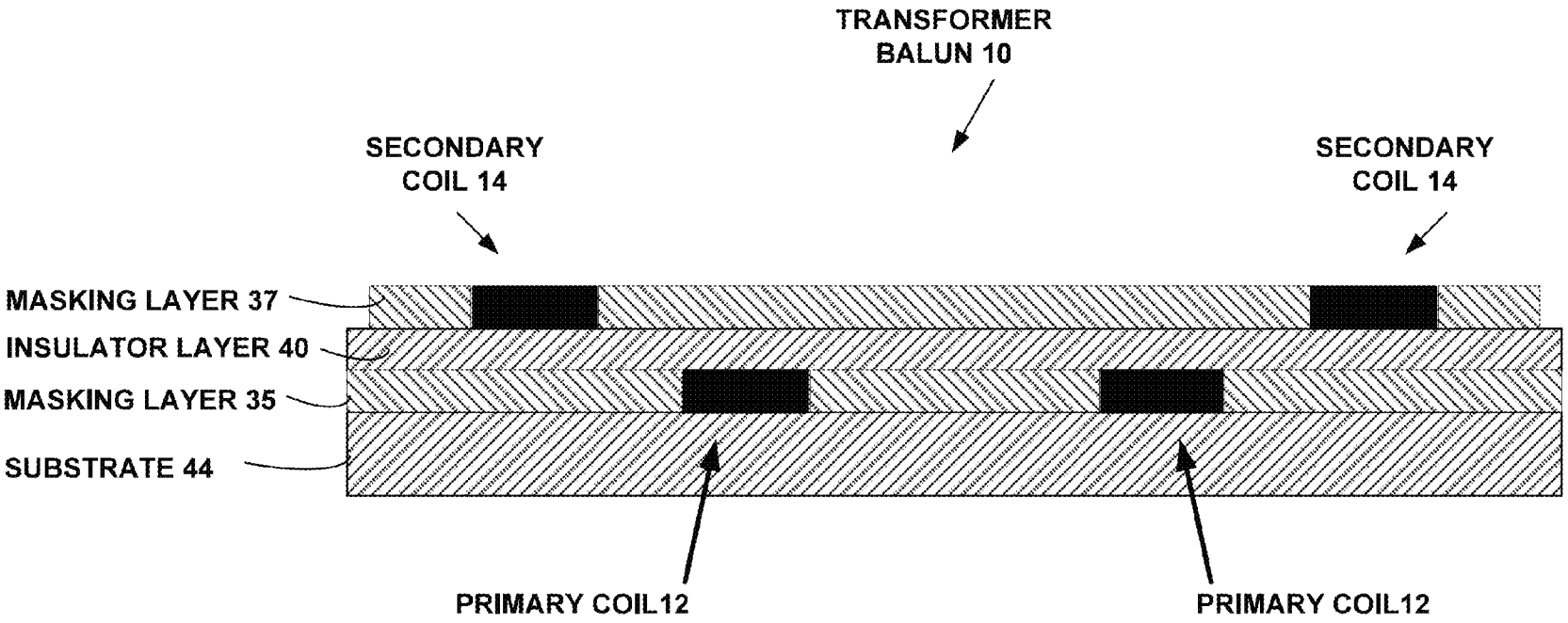
FIG. 7D illustrates an example embodiment of the invention, depicting a finished stage in the fabrication of the transformer balun, wherein the secondary coil is positioned on the surface of the insulator layer and the primary coil is positioned below the insulator layer, concentric with the secondary coil and the leads of which are offset by an angle of 90-degrees from the leads of the secondary coil, in accordance with an example embodiment of the invention.

FIG. 7D illustrates an example embodiment of the invention, depicting a finished stage in the fabrication of the transformer balun 10, wherein the metal secondary coil 14 is positioned on the surface of the insulator layer 40 and the metal primary coil 12 is positioned below the insulator layer 40. The third and fourth differential leads 20 and 22 of the secondary coil 14 are oriented in a second direction X, offset by an angle of 90-degrees from the first direction Y for the first and second differential leads 16 and 18 of the primary coil, as shown in FIG. 2. The primary coil 12 has a diameter of approximately 50 micrometers and is concentric with the secondary coil 14 having a diameter of approximately 70 micrometers.

A simulation of an example embodiment of the invention was conducted and compared with simulations of alternate transformer balun structures.

1) The simulation is setup to analyze common mode rejection ratio (CMRR) and Gmax (maximum gain) of the transformer baluns under reasonable on-chip assumptions. The transformer balun is simulated in the frequency range 90-100 GHz, and the data given here are for the 95 GHz point.
2) Four physical models were simulated. There were 90-degree orientations and 180-degree orientations of the balun leads. There were concentric (different diameter) primary/secondary coils and stacked/same-size primary/secondary coils. The simulated transformer balun with the 90-degree orientation and the concentric (different diameter) primary/secondary coils was found to have the best common mode rejection ratio (CMRR) should be preferred for high-frequency design.
3) The results of optimization for 90- and 180-degree oriented transformer baluns are summarized below. Since the primary coils are different in size for the concentric and same-size baluns their Gmax=S21 are different.
   a. 90-degree, concentric: CMRR=33.6 dB, Gmax=S21=−1.1 dB
   b. 180-degree, concentric: CMRR=23.3 dB, Gmax=S21=−1.0 dB
   c. 90-degree, stacked/same-size: CMRR=30.2 dB, Gmax=S21=−1.76 dB
   d. 180-degree, stacked/same-size: CMRR=17.8 dB, Gmax=S21=−0.75 dB
4) It is seen that the CMRR is maximized for the example embodiment of the invention, wherein the transformer balun has the 90-degree orientation for the leads and the concentric (different diameter) primary/secondary coils.
5) Among other benefits, the 90-degree configuration may require a smaller capacitance on the secondary, which may save area on-chip and may improve the self-resonant frequency of the transformer balun.

Advantages:

In accordance with an example embodiment of the invention, the minimized parasitic capacitance allows for high self-resonant frequency and makes this design particularly useful for microwave and millimeter-wave single-to-differential conversion or differential-to-single-ended conversion. In particular, the single-turn primary and secondary coils may be useful at millimeter-wave frequencies where multi-turn transformers may not typically be used due to too low self-resonant frequencies.

In accordance with an example embodiment of the invention, the balancing of differential output (when used in a single-to-differential conversion configuration) is achieved with geometric modification, based on balanced impedances of a region of the primary coil as seen by the secondary coil's leads, through capacitive and inductive coupling between the primary and secondary coil. This reduces loss, compared to balancing through the use of added capacitors at the secondary center-tap, for example.

In accordance with an example embodiment of the invention, for a given level of common mode rejection, less "balancing" capacitance is required to be placed (potentially zero), and may be easily be placed at the secondary coil's center-tap. The secondary coil may be substantially geometrically symmetric.

In accordance with an example embodiment of the invention, the placement of a balancing capacitance (if needed) at the primary coil's center tap, rather than or in addition to the secondary coil's center tap, may help to reduce common-mode oscillation problems in the differential circuit connected to the secondary coil. This is because less capacitance is required at the secondary coil's center tap for differential signal balance, compared to alternate 0-degree or 180-degree transformers. Instead, a higher impedance may be placed at the secondary coil's center-tap to quench common mode oscillation by reducing the quality factor of the common mode impedance.

In accordance with an example embodiment of the invention, the 90-degree difference in orientation of the two coils may allow more compact or convenient circuit layouts. All four sides of the transformer balun 10 are accessible and may serve a different purpose. The primary leads, the primary coil's center-tap, the secondary coil's leads, and the secondary coil's center-tap each occupy a separate boundary of a rectangular boundary surrounding the transformer balun 10. Access to the center-taps and primary/secondary coils is unrestricted.

The resulting example embodiments of the invention provide an improved transformer balun having a maximized common mode rejection ratio and improved self-resonant frequency due to a reduced need for capacitance added to the center-taps of the windings.

Although specific example embodiments have been disclosed, a person skilled in the art will understand that changes can be made to the specific example embodiments without departing from the spirit and scope of the invention.

What is claimed is:

1. A transformer balun, comprising:

a first winding of at least one turn forming a primary coil, having first and second differential leads oriented in a first direction and connected at a center tap of the primary coil, the primary coil formed in a first conductive layer over a substrate and the first differential lead of the primary coil being grounded, the second differential lead providing a first terminal of the balun; and a second winding of at least one turn forming a secondary coil, having a third and fourth differential leads providing second terminals of the balun, oriented in a second direction offset by an angle of substantially ninety degrees from the first direction and connected at a center tap of the secondary coil, the secondary coil formed in a second conductive layer separated by an insulating layer from the first conductive layer, the first and second windings capacitively and inductively coupled forming an equivalent return-path inductance in both the third and fourth differential leads of the balun;

wherein the primary coil and the secondary coil form a transformer balun wherein having:

the first differential lead of the primary coil being a half-coil with a second segment and a fourth segment, that are substantially grounded and the second differential lead of the primary coil being a half-coil with a first segment and a third segment, that are a substantially higher impedance and provide the first terminal of the balun;

the third differential lead of the secondary coil being a half-coil with a third segment parallel to and capacitively and inductively coupling with the higher impedance third segment of the primary coil, and a fourth segment parallel to and capacitively and inductively coupling with the grounded fourth segment of the primary coil, the third differential lead providing a first one of the second terminals of the balun;

the fourth differential lead of the secondary coil being a half-coil with first segment parallel to and capacitively and inductively coupling with the higher impedance first segment of the primary coil, and a second segment parallel to and capacitively and inductively coupling with the grounded second segment of the primary coil, the fourth differential lead providing a second one of the second terminals of the balun;

whereby aggregate impedances in the third differential lead and in the fourth differential lead of the secondary coil are substantially equivalent, to maximize common mode rejection.

2. The transformer balun of claim 1, wherein the primary coil has a different diameter than the secondary coil.

3. The transformer balun of claim 1, wherein the offset angle in the orientation of the primary and secondary coils, provides the third and fourth differential leads of the secondary coil with equivalent aggregate impedance, due to balanced capacitive and inductive coupling to the primary coil, thereby maximizing common mode rejection for the third and fourth differential leads of the secondary coil.

4. The transformer balun of claim 1, wherein the first and second leads of the primary coil are on the same side of the transformer balun as one another; and the third and fourth leads of the secondary coil are on the same side of the transformer balun as one another, reducing parasitic ground loop inductance between the leads of each pair.

5. A method, comprising:

forming, with an apparatus, a primary coil of a balun, of at least one turn in a first conductive layer over a substrate, the primary coil having first and second differential leads oriented in a first direction and connected at a center tap of the primary coil and the first differential lead of the primary coil being grounded, the second differential lead providing a first terminal of the balun; and forming, with an apparatus, a secondary coil of the balun, of at least one turn in a second conductive layer separated by an insulating layer from the first conductive layer, the secondary coil having a third and fourth differential leads providing second terminals of the balun, oriented in a second direction offset by an angle of substantially ninety degrees from the first direction and connected at a center tap of the secondary coil, the primary and secondary coils capacitively and inductively coupled forming an equivalent return-path inductance in both the third and fourth differential leads of the balun;

wherein the primary coil and the secondary coil form a transformer balun having:

the first differential lead of the primary coil being a half-coil with a second segment and a fourth segment, that are substantially grounded and the second differential lead of the primary coil being a half-coil with a first segment and a third segment, that are a substantially higher impedance and provide the first terminal of the balun;

the third differential lead of the secondary coil being a half-coil with a third segment parallel to and capacitively and inductively coupling with the higher impedance third segment of the primary coil, and a fourth segment parallel to and capacitively and inductively coupling with the grounded fourth segment of the primary coil, the third differential lead providing a first one of the second terminals of the balun;

the fourth differential lead of the secondary coil being a half-coil with first segment parallel to and capacitively and inductively coupling with the higher impedance first segment of the primary coil, and a second segment parallel to and capacitively and inductively coupling with the grounded second segment of the primary coil, the fourth differential lead providing a second one of the second terminals of the balun;

whereby aggregate impedances in the third differential lead and in the fourth differential lead of the secondary coil are substantially equivalent, to maximize common mode rejection.

6. The method of claim 5, wherein the primary coil has a different diameter than the secondary coil.

7. The method of claim 5, further comprising:

forming a center-tap of the primary coil that overlaps the third differential lead of the secondary coil; and overlapping the grounded first and the second differential leads of the primary coil with the fourth differential lead of the secondary coil.

8. The method of claim 5, wherein the offset angle in the orientation of the primary and secondary coils, provides the third and fourth differential leads of the secondary coil with equivalent aggregate impedance, due to balanced capacitive and inductive coupling to the primary coil, thereby maximizing common mode rejection for the third and fourth differential leads of the secondary coil.

9. The method of claim 5, wherein the first and second leads of the primary coil are on the same side of the transformer balun as one another; and the third and fourth leads of the secondary coil are on the same side of the transformer balun as one another, reducing parasitic ground loop inductance between the leads of each pair.

10. A transformer balun, comprising:

a first winding of at least one turn forming a first coil, having first and second differential leads oriented in a first direction and connected at a center tap of the first coil, the first coil formed in a first conductive layer over a substrate and the first differential lead of the first coil being grounded, the second differential lead providing a first terminal of the balun; and a second winding of at least one turn forming a second coil, having a third and fourth differential leads providing second terminals of the balun, oriented in a second direction offset by an angle of substantially ninety degrees from the first direction and connected at a center tap of the second coil, the second coil formed in a second conductive layer separated by an insulating layer from the first conductive layer, the first and second windings capacitively and inductively coupled forming an equivalent return-path inductance in both the third and fourth differential leads of the balun;

wherein the first coil and the second coil form a transformer balun wherein having:

the first differential lead of the first coil being a half-coil with a second segment and a fourth segment, that are substantially grounded and the second differential lead of the first coil being a half-coil with a first segment and a third segment, that are a substantially higher impedance and provide the first terminal of the balun;

the third differential lead of the second coil being a half-coil with a third segment parallel to and capacitively and inductively coupling with the higher impedance third segment of the first coil, and a fourth segment parallel to and capacitively and inductively coupling with the grounded fourth segment of the first coil, the third differential lead providing a first one of the second terminals of the balun;

the fourth differential lead of the second coil being a half-coil with first segment parallel to and capacitively and inductively coupling with the higher impedance first segment of the first coil, and a second segment parallel to and capacitively and inductively coupling with the grounded second segment of the first coil, the fourth differential lead providing a second one of the second terminals of the balun;

whereby aggregate impedances in the third differential lead and in the fourth differential lead of the second coil are substantially equivalent, to maximize common mode rejection.

11. The transformer balun of claim 10, wherein the first coil has a different diameter than the second coil.

12. The transformer balun of claim 10, wherein the offset angle in the orientation of the first and second coils, provides the third and fourth differential leads of the second coil with equivalent aggregate impedance, due to balanced capacitive and inductive coupling to the first coil, thereby maximizing common mode rejection for the third and fourth differential leads of the second coil.

13. The transformer balun of claim 10, wherein the first and second leads of the first coil are on the same side of the transformer balun as one another; and the third and fourth leads of the second coil are on the same side of the transformer balun as one another, reducing parasitic ground loop inductance between the leads of each pair.

* * * * *